US007048358B2

(12) United States Patent
Kubota et al.

(10) Patent No.: US 7,048,358 B2
(45) Date of Patent: May 23, 2006

(54) LIQUID DISCHARGE HEAD AND METHOD FOR MANUFACTURING SUCH HEAD

(75) Inventors: Masahiko Kubota, Tokyo (JP); Wataru Hiyama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 86 days.

(21) Appl. No.: 10/613,992

(22) Filed: Jul. 8, 2003

(65) Prior Publication Data

US 2004/0008239 A1 Jan. 15, 2004

(30) Foreign Application Priority Data

Jul. 10, 2002 (JP) ..... 2002-201873

(51) Int. Cl.
*B41J 2/05* (2006.01)

(52) U.S. Cl. ..... 347/56; 347/61; 347/65

(58) Field of Classification Search ..... 397/65, 397/63, 61, 60, 54, 20, 27, 41, 48, 84, 86, 397/56, 26, 14; 347/47, 56, 61, 62, 65
See application file for complete search history.

(56) References Cited

U.S. PATENT DOCUMENTS

| | | | | |
|---|---|---|---|---|
| 4,209,794 | A * | 6/1980 | Kattner | 347/47 |
| 4,882,595 | A | 11/1989 | Trueba et al. | |
| 5,218,376 | A | 6/1993 | Asai | |
| 6,155,673 | A | 12/2000 | Nakajima et al. | |
| 6,158,843 | A | 12/2000 | Murthy et al. | |
| 6,426,481 | B1 | 7/2002 | Koide et al. | |
| 6,472,125 | B1 | 10/2002 | Koide et al. | |
| 6,910,760 | B1 * | 6/2005 | Kubota et al. | 347/56 |

(Continued)

FOREIGN PATENT DOCUMENTS

| | | |
|---|---|---|
| CN | 1272818 | 11/2000 |

(Continued)

OTHER PUBLICATIONS

*Corresponding English-language patent document, EP 1 005 986, also cited in Second IDS filed Dec. 5, 2003.

*Primary Examiner*—Manish Shah
*Assistant Examiner*—Geoffrey S. Mruk
(74) *Attorney, Agent, or Firm*—Fitzpatrick Cella Harper & Scinto

(57) ABSTRACT

The present invention provides a liquid discharge head and a method for manufacturing such a head, in which a discharging speed of a liquid droplet can be increased, a discharging amount of the liquid droplet can be stabilized and discharging efficiency of the liquid droplet can be enhanced. The liquid discharge head comprises a heater, an element substrate on which the heater is provided, a nozzle including a discharge port portion having a discharge port for discharging the liquid droplet and a bubbling chamber and a supply path for supplying the liquid to the bubbling chamber and a supply chamber for supplying the liquid to the nozzle and an orifice substrate and, the bubbling chamber includes a first bubbling chamber and a second bubbling chamber above the first bubbling chamber and the discharge port portion is communicated with the second bulling chamber via a stepped portion and a side wall of the second bubbling chamber is converged toward the discharge port with inclination of 10 to 45 degrees and the nozzle is provided with a control portion comprised of a stepped portion in the flow path in the vicinity of the bubbling chamber and a maximum height of the flow path is smaller than a height up to a lower surface of the discharge port portion.

20 Claims, 14 Drawing Sheets

U.S. PATENT DOCUMENTS

| | | | | |
|---|---|---|---|---|
| 2003/0011655 | A1 | 1/2003 | Miyagawa et al. | |
| 2003/0016270 | A1* | 1/2003 | Kubota et al. | 347/47 |
| 2003/0030702 | A1 | 2/2003 | Komuro et al. | |
| 2004/0008240 | A1* | 1/2004 | Kubota et al. | 347/65 |
| 2004/0027422 | A1* | 2/2004 | Kubota et al. | 347/61 |

FOREIGN PATENT DOCUMENTS

| | | |
|---|---|---|
| EP | 0 867 292 | 9/1988 |
| EP | 1 005 986 | 6/2000 |
| EP | 1 186 414 | 3/2002 |
| JP | 54-161935 | 12/1979 |
| JP | 61-185455 | 8/1986 |
| JP | 61-249768 | 11/1986 |
| JP | 4-10940 | 1/1992 |
| JP | 4-10941 | 1/1992 |
| JP | 2000-255072 | 9/2000 |

* cited by examiner

LIQUID DISCHARGE HEAD AND METHOD FOR MANUFACTURING SUCH HEAD

BACKGROUND OF THE INVENTION

1. Field of the Invention

The present invention relates to a liquid discharge head for recording an image on a recording medium by discharging a liquid droplet such as an ink droplet and a method for manufacturing such a head, and more particularly, it relates to a liquid discharge head for performing ink jet recording.

2. Related Background Art

An ink jet recording system is one of so-called non-impact recording systems.

In the ink jet recording system, noise generated during the recording is very small which is negligible and high speed recording can be achieved. Further, the ink jet recording system has advantages that the recording can be performed on various recording media so that ink can be fixed with respect to even a so-called normal or plain paper without requiring special treatment and that a highly fine image can be obtained with a low cost. Due to such advantages, the ink jet recording system has recently been used widely not only as a peripheral device of a computer but also as recording means for a copier, a facsimile, a word processor and the like.

As ink discharging methods of the ink jet recording system generally used, there are a method in which an electrical/thermal converting element such as a heater is used as a discharge energy generating element used for discharging an ink droplet and a method in which a piezoelectric element is used, and, in both methods, the discharging of the ink droplet can be controlled by an electric signal. A principle of the ink discharging method using the electrical/thermal converting element is that, by applying voltage to the electrical/thermal converting element, the ink in the vicinity of the electrical/thermal converting element is boiled instantaneously so that the ink droplet is discharged at a high speed by rapid growth of a bubble caused by phase change of the ink during the boiling. On the other hand, a principle of the ink discharging method using the piezoelectric element is that, by applying voltage to the piezoelectric element, the piezoelectric element is displaced to generate pressure by which the ink droplet is discharged.

The ink discharging method using the electrical/thermal converting element has advantages that a great space for containing the discharge energy generating element is not required and that a structure of the liquid discharge head is simple and nozzles can easily be laminated. On the other hand, inherent disadvantages of this ink discharging method are that a volume of the flying ink droplet is changed when heat generated by the electrical/thermal converting element is accumulated in the liquid discharge head and that cavitation caused by extraction of the bubble affects a bad influence upon the electrical/thermal converting element and that, since air dissolved in the ink remains as residual bubbles, a bad influence is affected upon an ink droplet discharging property and image quality.

In order to eliminate such disadvantages, ink jet recording methods and liquid discharge heads have been proposed, as disclosed in Japanese Patent Application Laid-Open Nos. 54-161935, 61-185455, 61-249768 and 4-10941. That is to say, the ink jet recording methods disclosed in such patent documents are designed so that the bubble generated by driving the electrical/thermal converting element in response to a recording signal is communicated with atmosphere. By using such ink jet recording methods, the volume of the flying ink droplet is stabilized so that a very small amount of ink droplet can be discharged at a high speed and endurance of the heater can be enhanced by eliminating the cavitation generated by extraction of the bubble, thereby obtaining a further finer image easily. In the above-mentioned documents, as an arrangement in which the bubble is communicated with the atmosphere, an arrangement in which a minimum distance between the electrical/thermal converting element and the discharge port is made to be considerably smaller than the minimum distance in the prior art is described.

Now, such a conventional liquid discharge head will be explained. The conventional liquid discharge head includes an element substrate on which electrical/thermal converting elements for discharging the ink and an orifice substrate joined to the element substrate and constituting ink flow paths. The orifice substrate is provided with a plurality of discharge ports for discharging an ink droplet, a plurality of nozzles through which the ink flows and a supply chamber for supplying the ink to the respective nozzles. Each nozzle includes a bubbling chamber in which a bubble is generated in the ink by the corresponding electrical/thermal converting element and a supply path for supplying the ink to the bubbling chamber. The element substrate is provided with the electrical/thermal converting elements disposed within the respective bubbling chambers. Further, the element substrate is provided with a supply port for supplying the ink to the supply chamber from a back side of a main surface of the element substrate contacted with the orifice substrate. The orifice substrate is provided with discharge ports opposed to the corresponding electrical/thermal converting elements on the element substrate.

In the conventional liquid discharge head having the above-mentioned construction, the ink supplied from the supply port to the supply chamber is supplied through the nozzles to fill the bubbling chambers. The ink supplied to each bubbling chamber is flown toward a direction substantially perpendicular to the main surface of the element substrate by a bubble generated by film boiling caused by the electrical/thermal converting element and is discharged from the discharge port as an ink droplet.

In a recording apparatus having the above-mentioned liquid discharge head, it is devised that a recording speed is made faster in order to obtain higher image quality output of a recorded image and a high quality image and high resolving power output. Regarding the conventional recording apparatus, U.S. Pat. Nos. 4,882,595 and 6,158,843 suggest a technique in which the discharging number of ink droplets flying from each nozzle of the liquid discharge head is increased, i.e. discharging frequency is increased in order to increase the recording speed.

Particularly, in U.S. Pat. No. 6,158,843, there is proposed an arrangement in which a flow of the ink from the supply port to the supply path is improved by providing a restriction space or a fluid resistance element which restricts the passage for the ink locally in the vicinity of the supply port.

Further, Japanese Patent Application Laid-Open No. 2000-255072 discloses a manufacturing method in which a single soluble resin layer is used on an element substrate so that, when the organic resin layer is exposed and developed, by using a photo-mask having a pattern smaller than a limited resolving power, a partially recessed portion is formed in each supply path. However, an upper surface of the flow path pattern formed by this method includes minute unevenness by the influence of scattering of exposing light.

By the way, in the above-mentioned conventional liquid discharge head, when the ink droplet is discharged, a part of the ink filled in each bubbling chamber is pushed back toward the supply path by the bubble growing in the bubbling chamber. Thus, there is inconvenience that the discharging amount of the ink droplet is decreased by reduction in volume of the ink in the bubbling chamber.

Further, in the conventional liquid discharge head, when the part of the ink filled in the bubbling chamber is pushed back toward the supply path, a part of pressure of the growing bubble facing to the supply port is escaped toward the supply path or is lost by friction between inner walls of the bubbling chamber and the bubble. Thus, the conventional liquid discharge head has a problem that the discharging speed of the ink droplet is decreased by reduction pressure of the bubble.

Further, the conventional liquid discharge head also has a problem that, since the volume of the small amount of ink filled in the bubbling chamber is changed by the bubble growing in the bubbling chamber, the discharging amount of the ink is dispersed.

SUMMARY OF THE INVENTION

Therefore, an object of the present invention is to provide a liquid discharge head and a method for manufacturing such a head in which a discharging speed of a liquid droplet is increased and a discharging amount of the liquid droplet is stabilized, thereby enhancing discharging efficiency of the liquid droplet.

To achieve the above object, the present invention provides a liquid discharge head comprising a discharge energy generating element for generating energy for discharging a liquid droplet, an element substrate having a main surface on which the discharge energy generating element is provided, a discharge port portion having a discharge port for discharging the liquid droplet, a bubbling chamber in which a bubble is generated in the liquid by the discharge energy generating element, a nozzle having a supply path for supplying the liquid to the bubbling chamber, a supply chamber for supplying the liquid to the nozzle, and an orifice substrate joined to the main surface of the element substrate, and wherein the bubbling chamber includes a first bubbling chamber which is communicated with the supply path and uses the main surface of the element substrate as a bottom surface thereof and in which the bubble is generated by the discharge energy generating element and a second bubbling chamber communicated with the first bubbling chamber and, the second bubbling chamber is communicated with the discharge port portion and, a central axis of a lower surface of the second bubbling chamber coincides with a center axial of an upper surface of the second bubbling chamber in a direction perpendicular to the substrate and, a sectional area of the upper surface with respect to the central axis of the second bubbling chamber is smaller than a sectional area of the lower surface with respect to the central axis of the second bubbling chamber and, the sectional area in the central axial direction is changed continuously from the lower surface to the upper surface of the second bubbling chamber and, the sectional area of the upper surface with respect to the center axis of the second bubbling chamber is greater than a sectional area with respect to a central axis of the discharge port portion.

Further, the liquid discharge head having the above-mentioned construction is designed so that a height, a width or a sectional area of the flow path is changed in the nozzle and, an ink volume is gradually decreased along a direction directing from the substrate to the discharge port, and, in the vicinity of the discharge port, there is provided a configuration or structure in which, when the liquid droplet is flying, the flying liquid droplet directs toward a direction perpendicular to the substrate and is subjected to a straightening (rectifying) action. Further, when the liquid droplet is discharged, it is possible to suppress the liquid filled in the bubbling chamber from being pushed toward the supply path by the bubble generated in the bubbling chamber. Accordingly, according to this liquid discharge head, the dispersion in the discharging volume of the liquid droplet discharged from the discharge port is suppressed, thereby maintaining the discharging volume properly. Further, in this liquid discharge head, by providing a control portion constituted by a stepped portion, when the liquid droplet is discharged, since the bubble growing in the bubbling chamber strikes against an inner wall of the control portion in the bubbling chamber, loss of pressure of the bubble can be suppressed. Thus, according to this liquid discharge head, since the bubble in the bubbling chamber is grown in a good manner to ensure the adequate pressure, the discharging speed of the liquid droplet is enhanced.

BRIEF DESCRIPTION OF THE DRAWINGS

FIG. 8A shows an element substrate, FIG. 8B shows a condition that a lower resin layer and an upper resin layer are formed on the element substrate, FIG. 8C shows a condition that a coating resin layer is formed, FIG. 8D shows a condition that a supply port is formed and FIG. 8E shows a condition that the lower resin layer and the upper resin layer are dissolved and flown out;

FIG. 9A shows the element substrate, FIG. 9B shows a condition that the lower resin layer is formed on the element substrate, FIG. 9C shows a condition that the upper resin layer is formed on the element substrate, FIG. 9D shows a condition that the upper resin layer formed on the element substrate is pattern-formed to form inclinations at side surfaces and FIG.

Figure 10A:
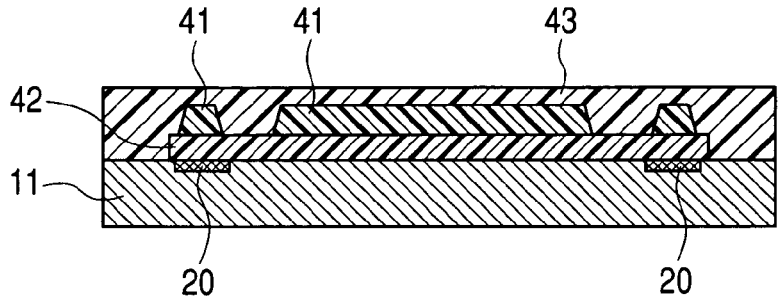
Figure 10B:
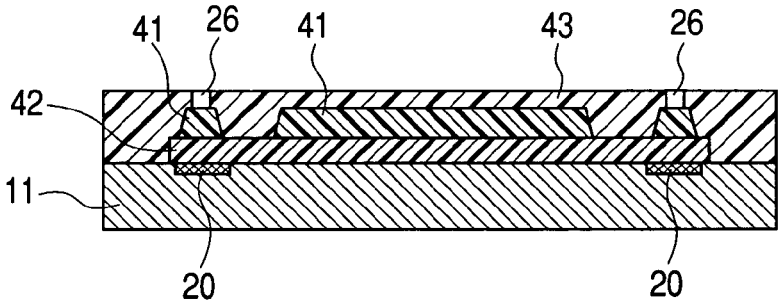
Figure 10C:
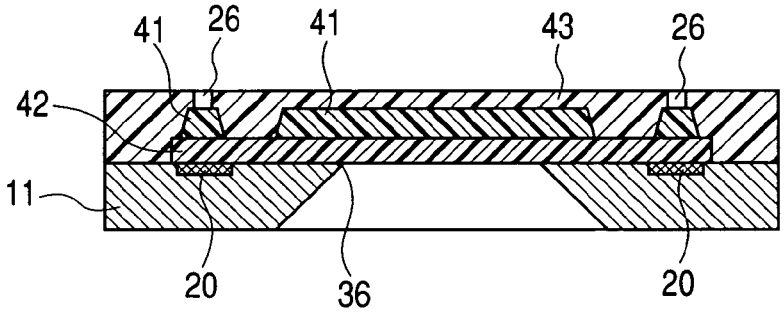
Figure 10D:
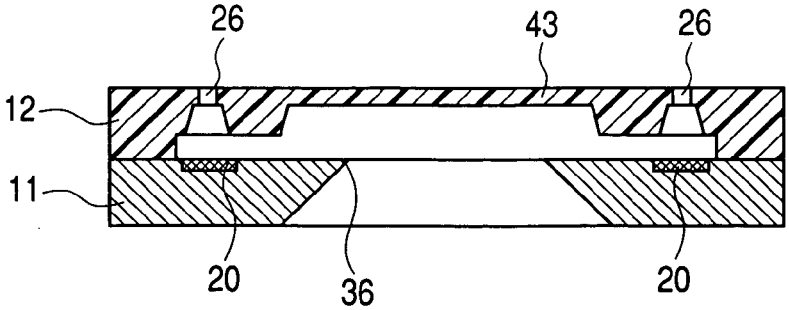
Figure 11:
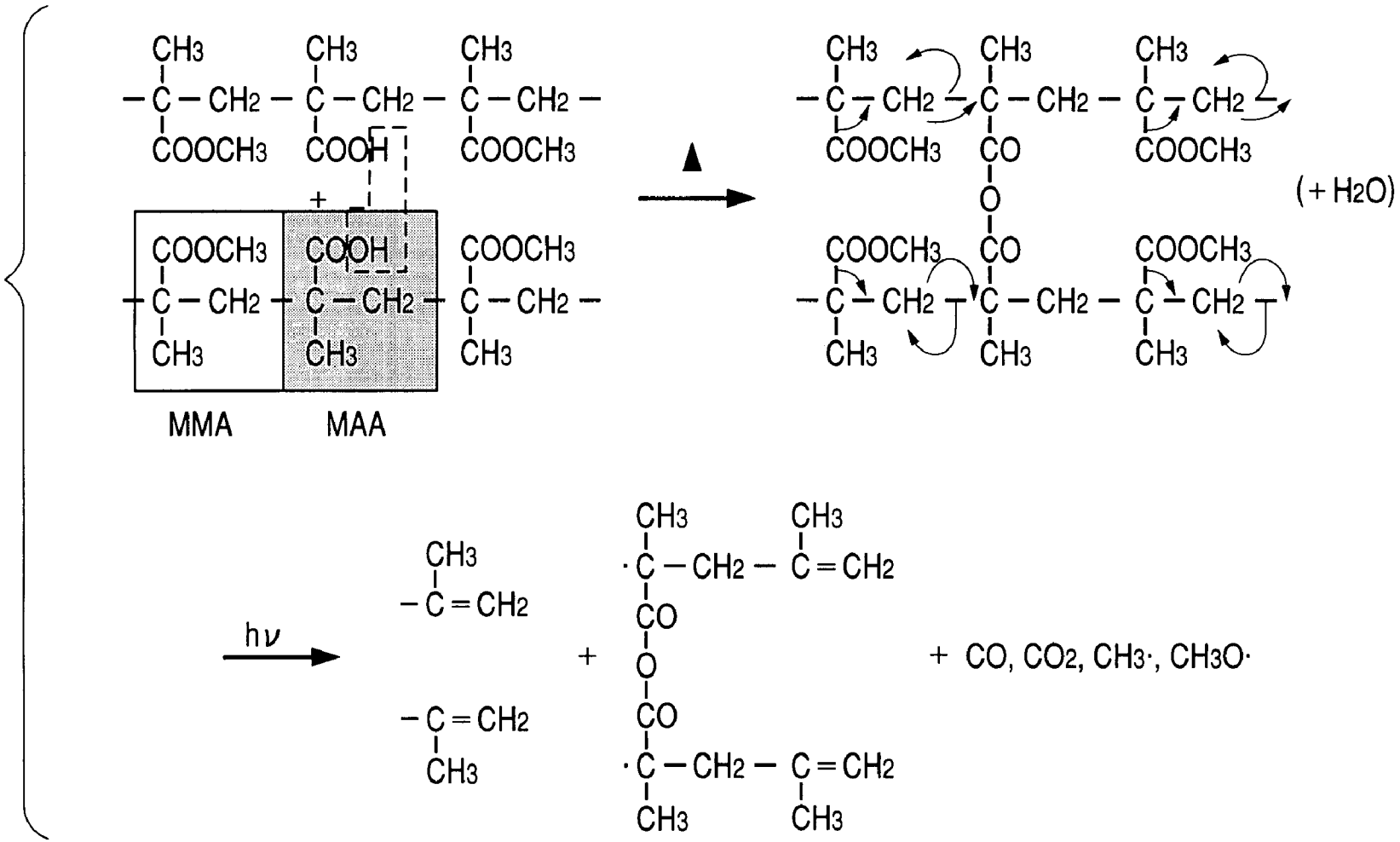
Figure 12:
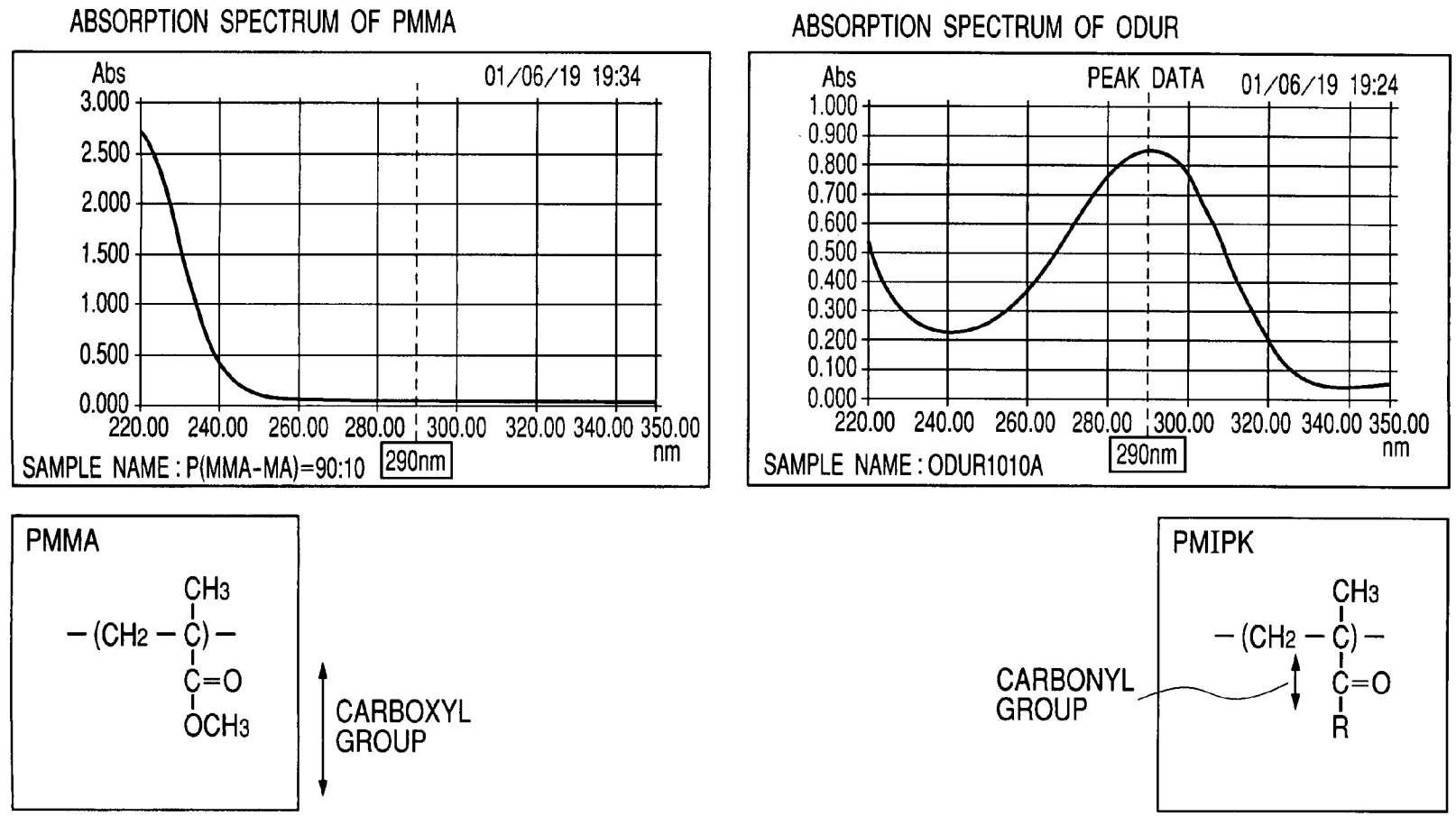
Figure 13:
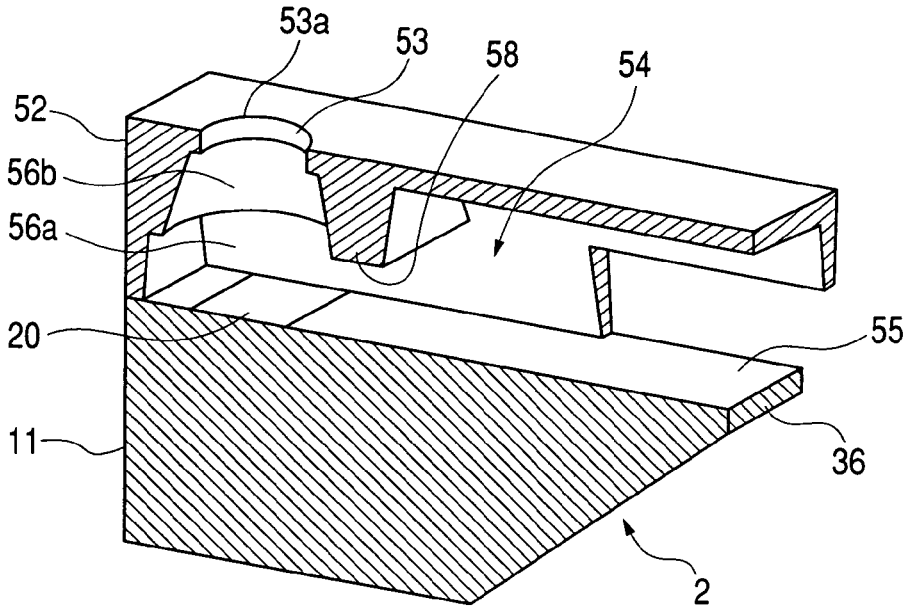
Figure 14:
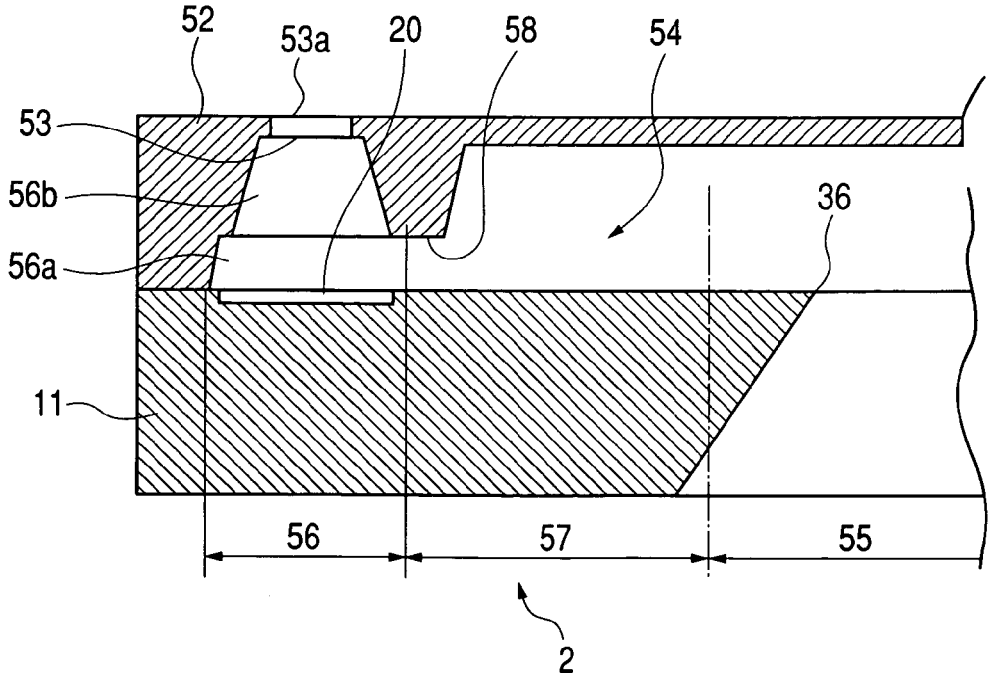
Figure 15:
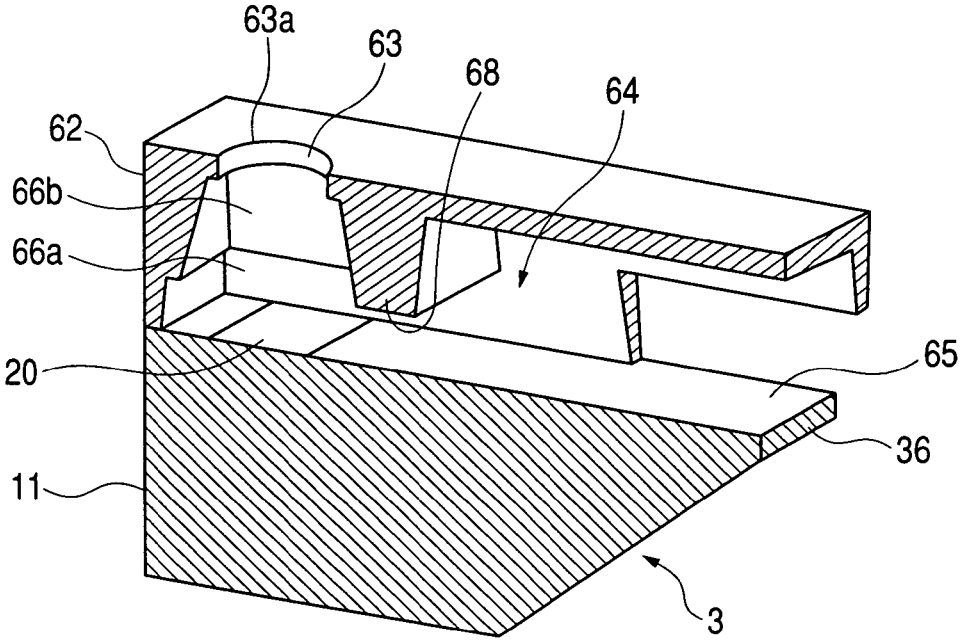
Figure 16:
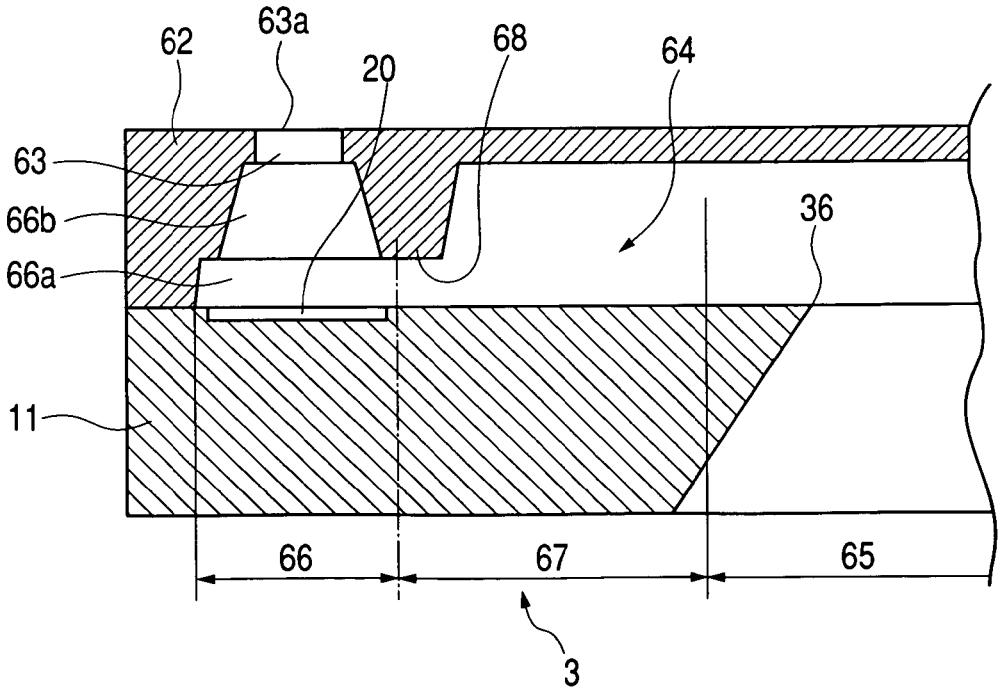
Figure 17A:
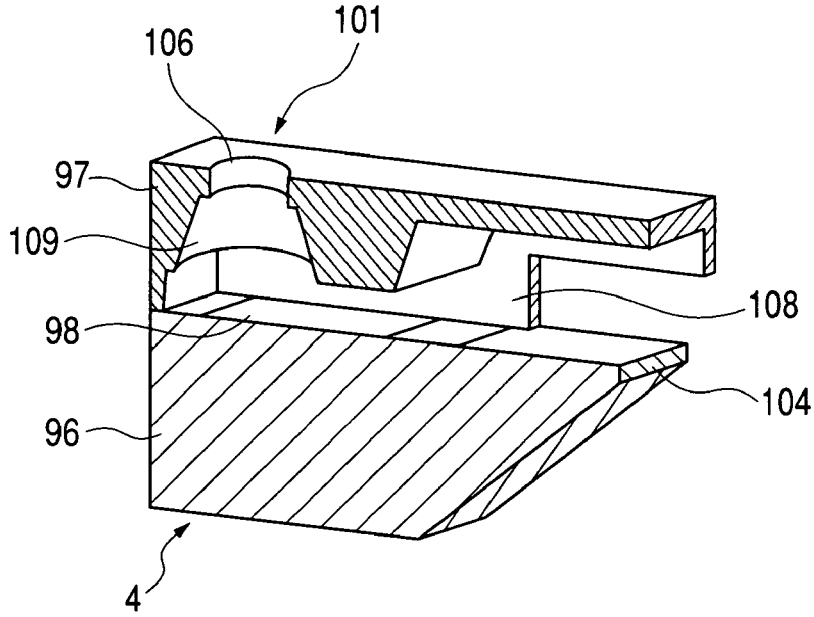
Figure 17B:
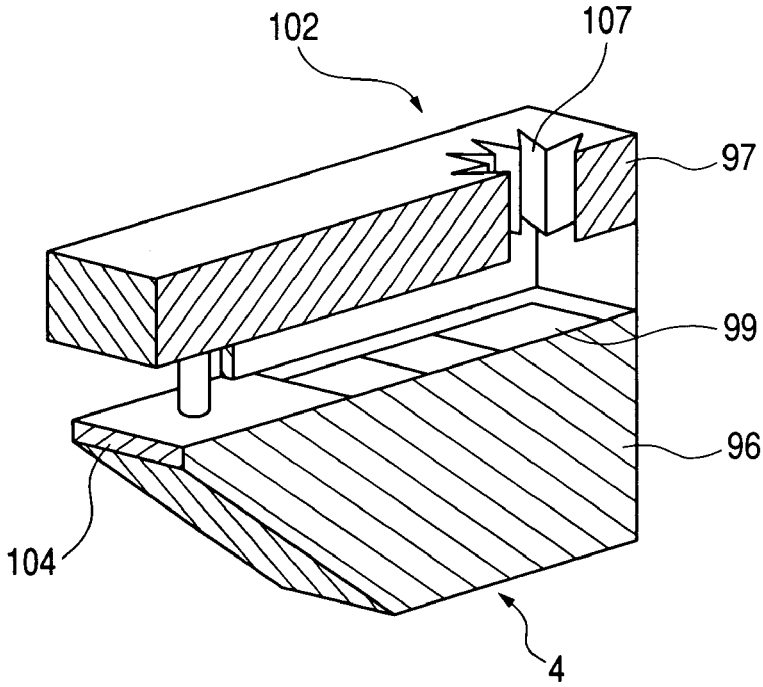
Figure 18A:
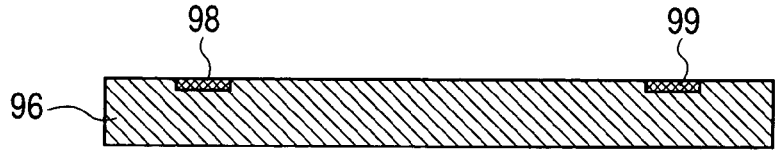
Figure 18B:
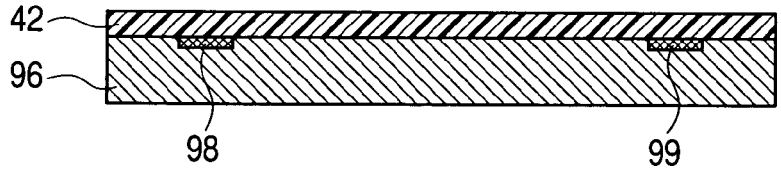
Figure 18C:
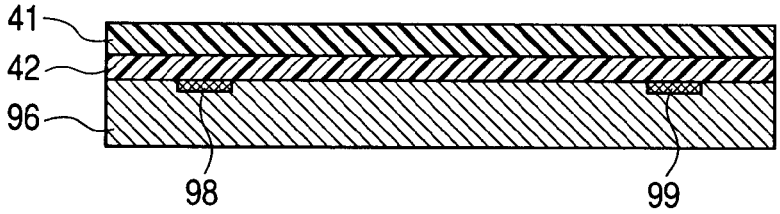
Figure 18D:
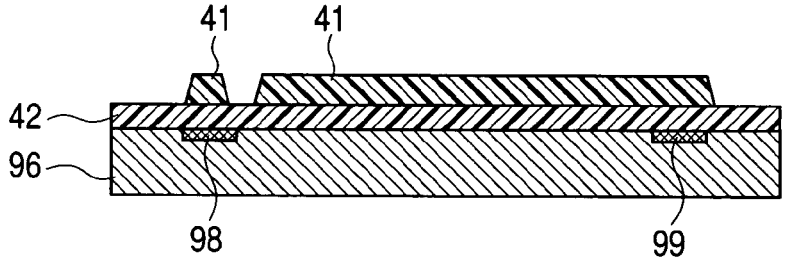
Figure 18E:
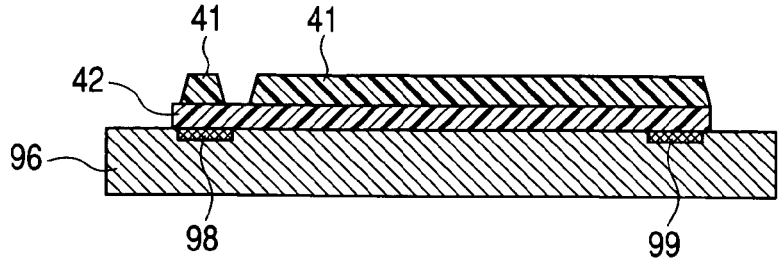
Figure 19A:
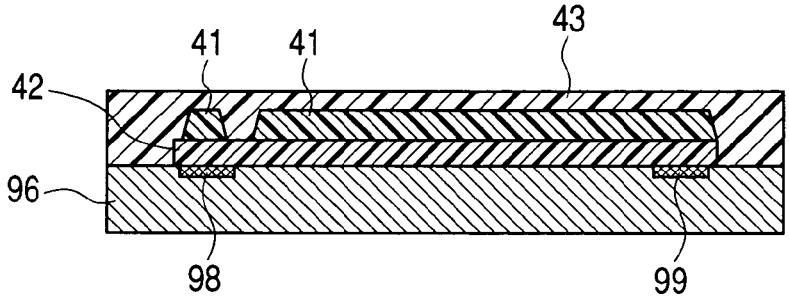
Figure 19B:
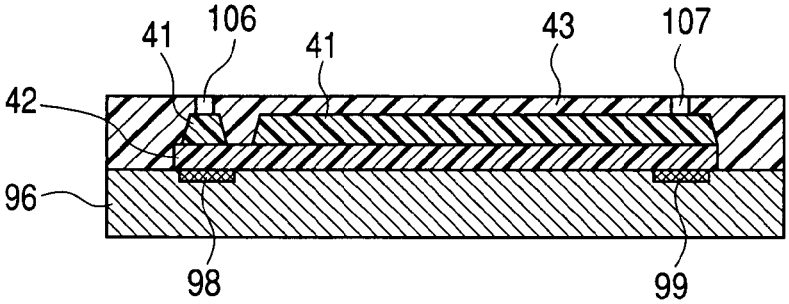
Figure 19C:
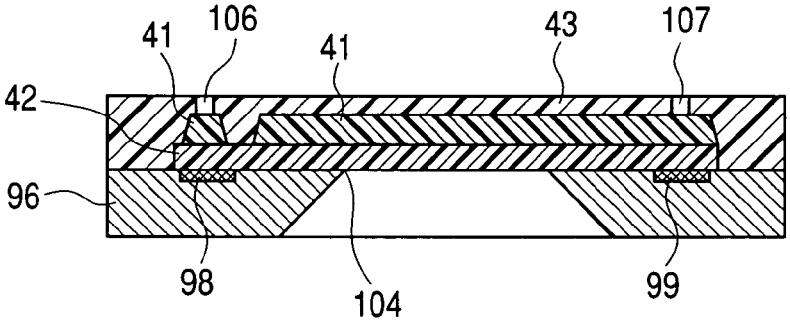
Figure 19D:
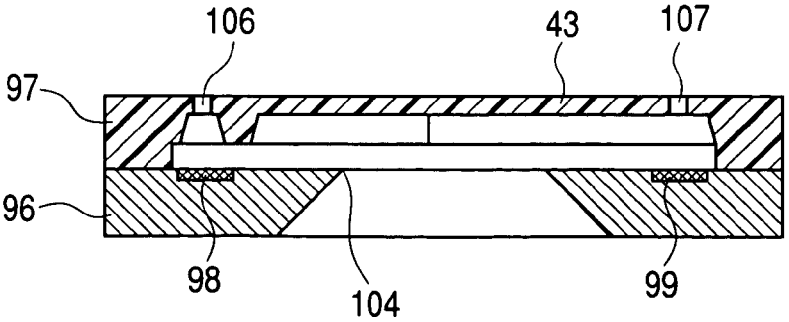

9E shows a condition that the lower resin layer formed on the element substrate is pattern-formed;

FIGS. 10A, 10B, 10C and 10D are second longitudinal sectional views for showing and explaining various steps for manufacturing the liquid discharge head according to the first embodiment of the present invention, where FIG. 10A shows a condition that the coating resin layer as an orifice substrate is formed, FIG. 10B shows a condition that a discharge port portion is formed, FIG. 10C shows a condition that a supply port is formed and FIG. 10D shows a condition that the liquid discharge head is completed by dissolving and flowing-out the lower resin layer and the upper resin layer;

FIG. 11 is a view showing a chemical reaction formula of the upper resin layer and the lower resin layer caused by illumination of an electron beam;

FIG. 12 is graphs showing absorption spectrum curves of materials of the lower resin layer and the upper resin layer in an area of 210 to 330 nm;

FIG. 13 is a perspective view, in partial section, for explaining a combined structure of a single heater and a nozzle in a liquid discharge head according to a second embodiment of the present invention;

FIG. 14 is a side sectional view for explaining the combined structure of the single heater and the nozzle in the liquid discharge head according to the second embodiment of the present invention;

FIG. 15 is a perspective view, in partial section, for explaining a combined structure of a single heater and a nozzle in a liquid discharge head according to a third embodiment of the present invention;

FIG. 16 is a side sectional view for explaining the combined structure of the single heater and the nozzle in the liquid discharge head according to the third embodiment of the present invention;

FIGS. 17A and 17B are perspective views, in partial section, for explaining a combined structure of a single heater and a nozzle in a liquid discharge head according to a fourth embodiment of the present invention, where FIG. 17A shows a nozzle in a first nozzle array and FIG. 17B shows a nozzle in a second nozzle array;

FIGS. 18A, 18B, 18C, 18D and 18E are first longitudinal sectional views for showing and explaining various steps for manufacturing the liquid discharge head according to the fourth embodiment of the present invention, where FIG. 18A shows an element substrate, FIG. 18B shows a condition that a lower resin layer is formed on the element substrate, FIG. 18C shows a condition that an upper resin layer is formed on the element substrate, FIG. 18D shows a condition that the upper resin layer formed on the element substrate is pattern-formed to form inclinations at side surfaces and FIG. 18E shows a condition that the lower resin layer formed on the element substrate is pattern-formed; and FIGS. 19A, 19B, 19C and 19D are second longitudinal sectional views for showing and explaining various steps for manufacturing the liquid discharge head according to the fourth embodiment of the present invention, where FIG. 19A shows a condition that the coating resin layer as an orifice substrate is formed, FIG. 19B shows a condition that a discharge port portion is formed, FIG. 19C shows a condition that a supply port is formed and FIG. 19D shows a condition that the liquid discharge head is completed by dissolving and flowing-out the lower resin layer and the upper resin layer.

DESCRIPTION OF THE PREFERRED EMBODIMENTS

Now, concrete embodiments of a liquid discharge head according to the present invention for discharging a liquid droplet such as an ink droplet will be explained with reference to the accompanying drawings.

First of all, a liquid discharge head according to an embodiment of the present invention will be briefly explained. The liquid discharge head according to this embodiment is a liquid discharge head in which, among ink jet recording systems, means for generating thermal energy as energy used for discharging liquid ink is provided and a system for changing the state of ink by such thermal energy is adopted. By using this system, high density and high fineness of a character and/or an image to be recorded can be achieved. Particularly, in this embodiment, a heat generating resistance body is used as the means for generating the thermal energy and ink is discharged by utilizing pressure of a bubble generated by film boiling caused by heating the ink by means of the heat generating resistance body.

FIRST EMBODIMENT

Figure 1:
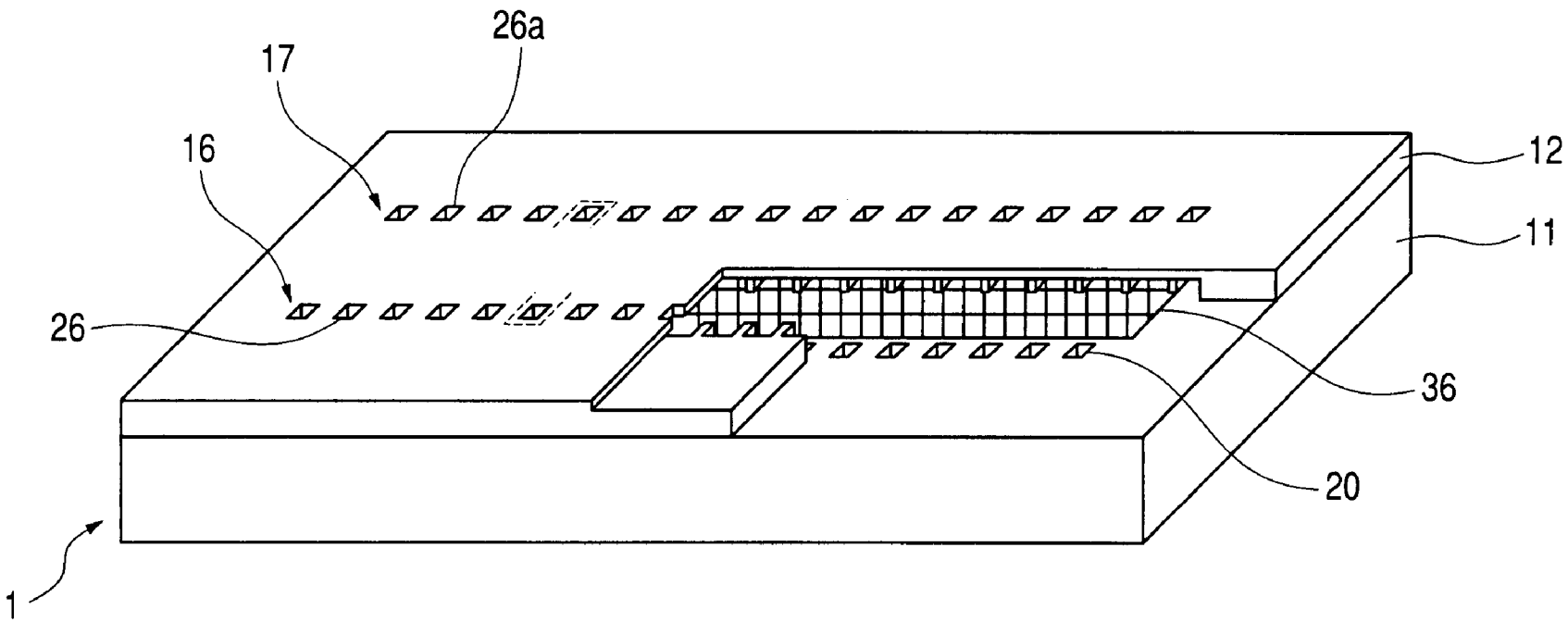
FIG. 1 is a schematic perspective view for explaining an entire construction of the liquid discharge head according to the present invention.

Although a detailed explanation will be made later, as shown in FIG. 1, in a liquid discharge head 1 according to a first embodiment of the present invention, partition walls for independently forming nozzles as ink flow paths for respective plural of heaters as heat generating resistance bodies extend from discharge ports to the vicinity of a supply port. Such a liquid discharge head includes ink discharging means using an ink jet recording method as disclosed in Japanese Patent Application Laid-Open Nos. 4-10940 and 4-10941 in which a bubble generated during the ink discharging is communicated with atmosphere via a discharge port.

The liquid discharge head 1 includes a first nozzle array 16 having plural heaters and plural nozzles and in which longitudinal directions of the respective nozzles are in parallel with each other and a second nozzle array 17 opposed to the first nozzle array with the interposition of a supply chamber. In both of the first nozzle array 16 and the second nozzle array 17, a distance between the adjacent nozzles is set to 600 dpi. Further, the nozzles in the second nozzle array 17 are staggered with respect to the adjacent nozzles in the first nozzle array 16 by ½ pitch.

Now, a conception for optimizing the liquid discharge head 1 having the first nozzle array 16 and the second nozzle array 17 in which the plural heaters and the plural nozzles are arranged with high density will be described briefly.

In general, as physical amounts affecting an influence upon a discharging property of the liquid discharge head, inertance (inertia force) and resistance (viscosity resistance) in the plural nozzles act greatly. Equation of motion of non-compressive fluid shifting in a flow path having any configuration is represented by the following two equations:

$$\Delta \cdot v = 0 \text{ (continuous equation)} \tag{1}$$

$$(\partial v/\theta t)+(v\cdot\Delta)=-\Delta(P/\rho)+(\mu/\rho)\Delta^2 v+f \text{ (Navie-Stokes equation)} \tag{2}$$

When the equations (1) and (2) are approximated as a fact that convection term and viscosity term are small adequately and there is no external force, the following equation $$\Delta^2 P=0 \tag{3}$$

is obtained, where the pressure is represented by using harmonic function.

Figure 2:
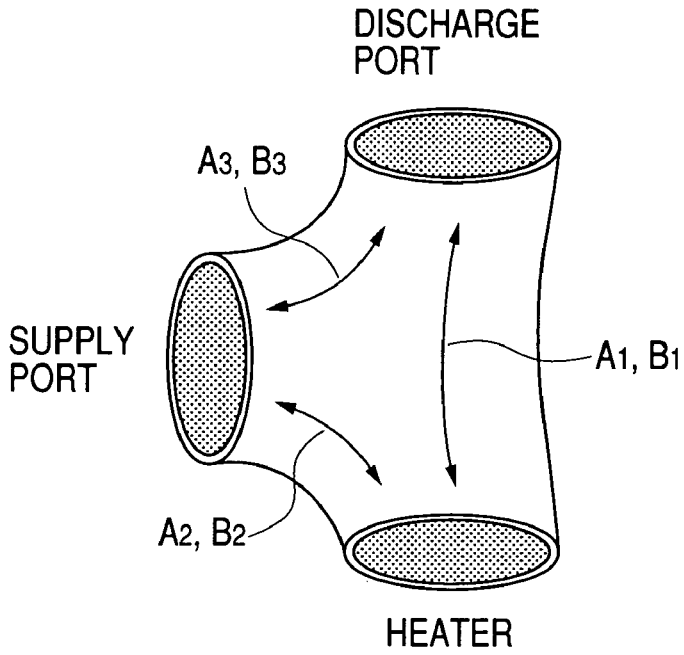
FIG. 2 is a schematic view showing a flow of fluid in the liquid discharge head as a three-opening model.
Figure 3:
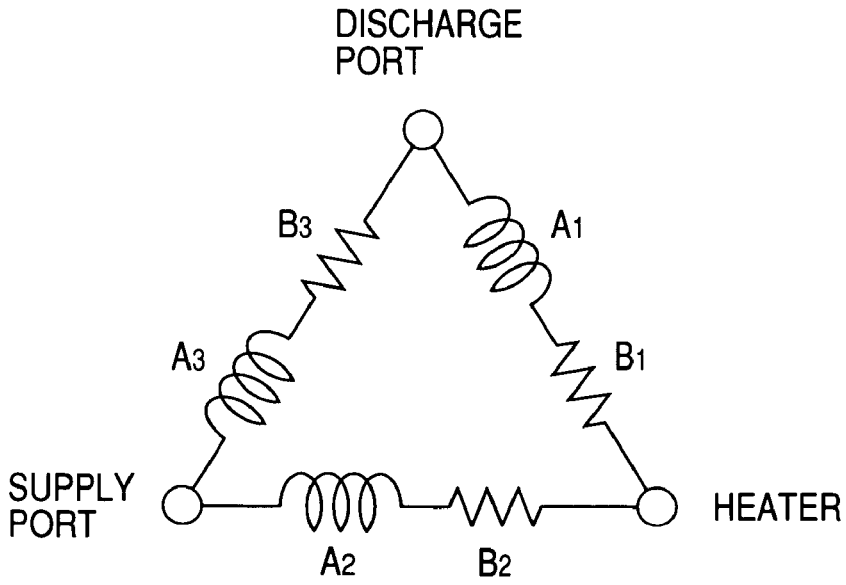
FIG. 3 is a schematic view showing the liquid discharge head as an equivalent circuit.

In case of the liquid discharge head, it can be expressed by a three-opening model as shown in FIG. 2 or an equivalent circuit as shown in FIG. 3.

The inertance is defined as "difficulty of movement" when stationary fluid is moved suddenly. Expressing electrically, the inertance acts similar to inductance L for blocking change in electric current. In a mechanical spring mass model, the inertance corresponds to weight (mass).

In a case where the inertance is represented by an equation, it is represented by a ratio with respect to two-stage time differential, i.e. time differential of a flow amount F (=ΔV/Δt) when difference in pressure is given in the opening:

$$(\Delta^2 V/\Delta t^2)=(\Delta F/\Delta t)=(1/A)\times P \quad (4)$$

where, A is intertance.

For example, in a case where a tube flow path having density ρ, length L and cross-sectional area $S_0$ is assumed falsely, the inertance $A_0$ of such suspected one-dimensional tube flow path can be represented by $$A_0=\rho\times L/S_0$$

From this equation, it can be seen that the inertance is in proportion to the length of the flow path and is in adverse proportion to the cross-sectional area.

On the basis of the equivalent circuit as shown in FIG. 3, the discharging property of the liquid discharge head can be estimated and analyzed in a model pattern.

In the liquid discharge head of the present invention, a discharging phenomenon is a phenomenon for shifting from inertia flow to viscosity flow. Particularly, in an initial bubbling stage in the bubbling chamber performed by the heater, the inertia flow becomes preferential; whereas, in a later discharging stage (time period from a time when a meniscus generated in the discharge port starts to be shifted toward the ink flow path to a time when the ink is restored by filling the ink up to the end face of the opening by a capillary phenomenon), the viscosity flow becomes preferential. In this case, from the above-mentioned relevant equations, in the initial bubbling stage, in accordance with the relationship of the inertance amount, contribution to the discharging property and particularly to the discharging volume and the discharging speed is increased; whereas, in the later discharging stage, the contribution of the resistance amount (viscosity resistance) to the discharging property and particularly to the time required for refilling the ink (referred to as "refill time" hereinafter) is increased.

The resistance (viscosity resistance) is represented by the above equation (1) and the following steady-state stokes flow represented by the following equation:

$$\Delta P=\eta\Delta^2\mu \quad (5)$$

In this way, viscosity resistance B can be sought. Further, in the later discharging stage, in the model shown in FIG. 2, since the meniscus is generated in the vicinity of the discharge port and the ink is flown mainly by a suction force due to the capillary force, the viscosity resistance can be approximated by a two-opening model (one-dimensional flow model).

That is to say, the viscosity resistance can be sought from the following equation (6) describing a Poiseuille's equation:

$$(\Delta V/\Delta t)=(1/G)\times(1/\eta)\{(\Delta P/\Delta x)\times S(x)\} \quad (6)$$

where, G is a shape factor. Further, since the viscosity resistance B is based upon fluid flowing in accordance with any pressure difference, it can be sought from the following equation:

$$B=\int_0^L\{(G\times\eta)/S(x)\}\Delta x \quad (7)$$

On the basis of the above equation (7), in a case where the resistance (viscosity resistance) is assumed as a tube flow path of pipe type having density ρ, length L and cross-sectional area $S_0$, the viscosity resistance is represented by the following equation:

$$B=8\eta\times L/(\Pi\times S_0^2) \quad (8)$$

Thus, approximately, the viscosity resistance is in proportion to the length of the nozzle and is in reverse proportion to square of the cross-sectional area of the nozzle.

In this way, in order to enhance the discharging property of the liquid discharge head, particularly all of the discharging speed, discharging volume of the ink droplet and the refill time, from the relationship of the inertance, it is required that the inertance amount from the heater toward the discharge port be is increased as much as possible in comparison with the inertance amount from the heater to the supply port and the resistance in the nozzle is decreased.

The liquid discharge head according to the present invention can satisfy both of the above-mentioned view-points and a proposition that the plural heaters and plural nozzles are arranged with high density.

Next, a concrete construction of the liquid discharge head according to the illustrated embodiment will be explained with reference to the accompanying drawings.

As shown in FIGS. 4 to 7, the liquid discharge head includes an element substrate 11 on which heaters 20 as plural discharge energy generating elements as heat generating resistance elements are provided, and an orifice substrate 12 laminated or joined to a main surface of the element substrate 11 to define a plurality of ink flow paths.

For example, the element substrate 11 is formed from glass, ceramics, resin, metal or the like and is generally formed from silicon.

The heaters 20 corresponding to the respective ink flow paths, electrodes (not shown) for applying voltage to the heaters 20 and wirings (not shown) connected to the electrodes are provided on the main surface of the element substrate 11 in a predetermined wiring pattern.

Figure 8A:
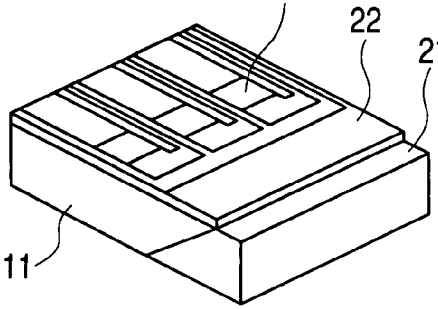
FIGS. 8A, 8B, 8C, 8D and 8E are perspective views for explaining a method for manufacturing the liquid discharge head according to the first embodiment of the present invention, where

Further, an insulation film 21 for covering the heaters 20 and for enhancing dispersing accumulated heat is also provided on the main surface of the element substrate 11 (see FIG. 8A). Further, a protection film 22 for protecting the main surface from cavitation generated when the bubble is extinguished is provided on the main surface of the element substrate 11 to cover the insulation film 21 (see FIG. 8A).

Figure 4:
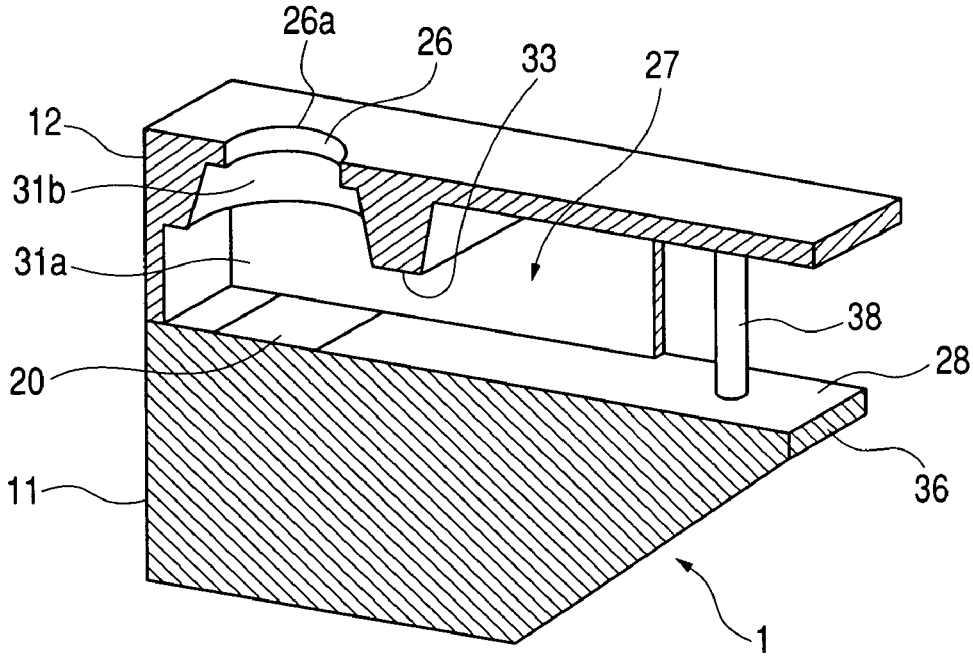
FIG. 4 is a perspective view, in partial section, for explaining a combined structure of a single heater and a nozzle in a liquid discharge head according to a first embodiment of the present invention.
Figure 5:
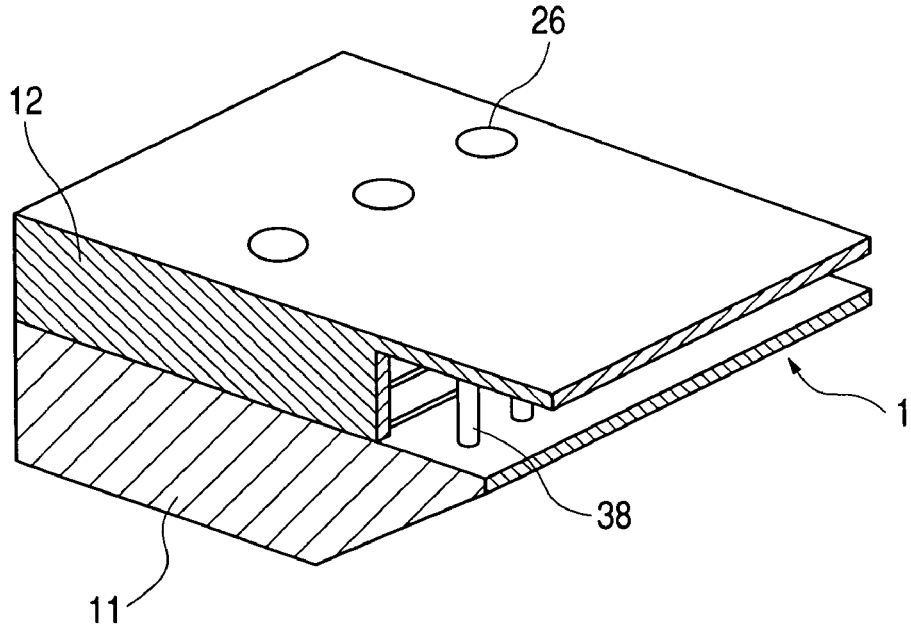
FIG. 5 is a perspective view, in partial section, for explaining a combined structure of plural heaters and nozzles in the liquid discharge head according to the first embodiment of the present invention.
Figure 6:
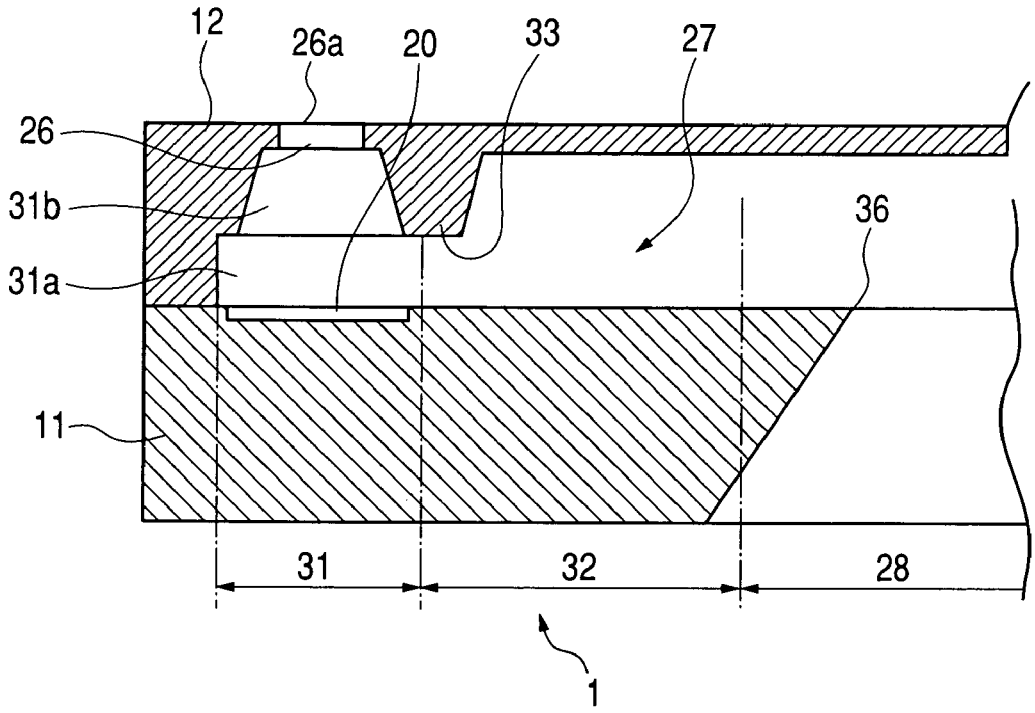
FIG. 6 is a side sectional view for explaining the combined structure of the single heater and the nozzle in the liquid discharge head according to the first embodiment of the present invention.
Figure 7:
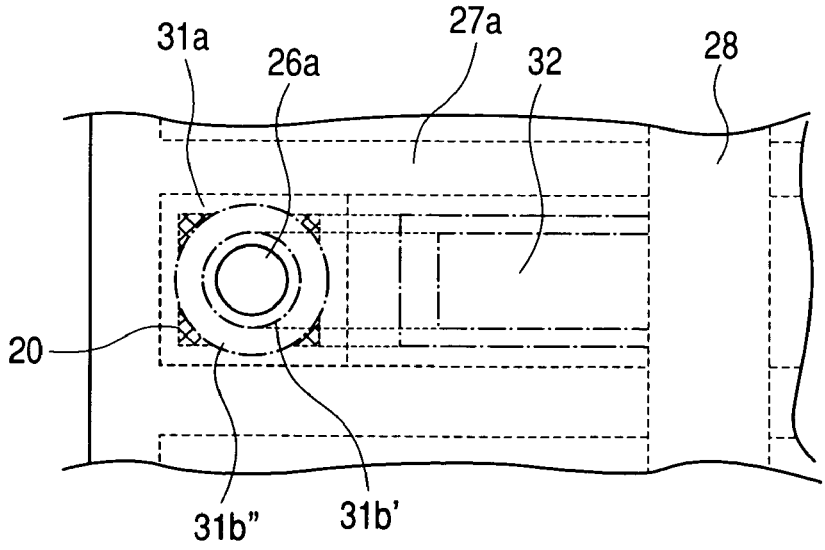
FIG. 7 is a plan sectional view for explaining the combined structure of the single heater and the nozzle in the liquid discharge head according to the first embodiment of the present invention.

The orifice substrate 12 is formed from resin material to have a thickness of about 30 μm. As shown in FIGS. 4 and 5, the orifice substrate 12 includes a plurality of discharge port portions 26 for discharging the ink droplet and also includes a plurality of nozzles 27 through which the ink moves and supply chambers 28 for supplying the ink to the nozzles 27.

The nozzle 27 includes a discharge port portion 26 having a discharge port 26*a* for discharging the liquid droplet, a bubbling chamber 31 in which a bubble is generated in the liquid by means of the corresponding heater 20 as the discharge energy generating element and a supply path 32 for supplying the liquid to the bubbling chamber 31.

The bubbling chamber 31 comprises a first bubbling chamber 31*a* which uses the main surface of the element substrate 11 as a bottom surface thereof and is communicated with the supply path 32 and in which the bubble is generated in the liquid by the heater 20 and a second bubbling chamber 31*b* which is communicated with an opening of an upper surface of the first bubbling chamber 31*a* parallel with the main surface of the element substrate 11 and in which the bubble generated in the first bubbling chamber 31*a* is growing and, the discharge port portion 26 is communicated with an opening of an upper surface of the second bubbling chamber 31*b* and a stepped portion is provided between a side wall surface of the discharge port portion 26 and a side wall surface of the second bubbling chamber 31*b*.

The discharge port 26*a* of the discharge port portion 26 is formed at a position opposed to the heater 20 provided on the element substrate 11 and, in the illustrated embodiment, the discharge port is a circular hole having a diameter of about 15 μm, for example. Incidentally, the discharge port 26*a* may be formed as a substantially radial star shape in dependence upon requirement of the discharging property.

The second bubbling chamber 31*b* has a frusto-conical shape and a side wall thereof is reduced toward the discharge port with inclination of 10 to 45 degrees with respect to a plane perpendicular to the main surface of the element substrate and an upper surface thereof is communicated with an opening of the discharge port portion 26 with the interposition of a stepped portion.

The first bubbling chamber 31*a* is disposed on an extension line of the supply path 32 and the bottom surface thereof facing to the discharge port 26 is formed as a substantially rectangular shape.

The nozzle 27 is formed so that a minimum distance HO between a main surface of the heater 20 parallel with the main surface of the element substrate 11 and the discharge port 26*a* becomes smaller than 30 μm.

In the nozzle 27, the upper surface of the first bubbling chamber 31*a* parallel with the main surface and an upper surface of the supply path 32 adjacent to the bubbling chamber 31 and parallel with the main surface are continued and are flush with each other and, the upper surface of the supply path is connected to a higher upper surface of the supply path 32 adjacent to the supply chamber 28 and parallel with the main surface of the element substrate via a stepped portion inclined with respect to the main surface, so that a space from the stepped portion to the opening of the bottom surface of the second bubbling chamber 31*b* constitutes a control portion 33 which controls the movement of the ink in the bubbling chamber 31 caused by the bubble. A maximum height from the main surface of the element substrate 11 to the upper surface of the supply path 32 is set to be smaller than a height from the main surface of the element substrate 11 to the upper surface of the second bubbling chamber 31*b*.

The supply path 32 has one end communicated with the bubbling chamber 31 and the other end communicated with the supply chamber 28.

As such, in the nozzle 27, due to the presence of the control portion 33, the height with respect to the main surface of the element substrate 11 at a region extending from one end of the supply path 32 adjacent to the first bubbling chamber 31*a* and through the first bubbling chamber 31*a* is lower than the other end of the supply path 32 adjacent to the supply chamber 28. Accordingly, in the nozzle 27, due to the presence of the control portion 33, a sectional area of the ink flow path at the region extending from one end of the supply path 32 adjacent to the first bubbling chamber 31*a* and through the first bubbling chamber 31*a* is smaller than the other sectional area of the flow path.

Further, as shown in FIGS. 4 to 7, a width of the nozzle 27 perpendicular to an ink flowing direction in a plane of the flow path parallel with the main surface of the element substrate is formed as a substantially similar straight shape at a region extending from the supply chamber 28 and through the bubbling chamber 31. Further, various inner wall surfaces of the nozzle 27 opposed to the main surface of the element substrate 11 are formed to be parallel with the main surface of the element substrate 11 at the region extending from the supply chamber 28 and through the bubbling chamber 31.

Here, in the nozzle 27, a height of a surface of the control portion 33 opposed to the main surface of the element substrate 11 is formed to be about 14 μm, for example, and a height of a surface of the supply chamber 28 opposed to the main surface of the element substrate 11 is formed to be about 25 μm, for example. Further, in the nozzle 27, a length of the control portion 33 parallel with the ink flowing direction is formed to be about 10 μm, for example.

Further, the element substrate 11 is provided with a supply port 36 at a rear surface of the main surface adjacent to the orifice substrate 12, which supply port serves to supply the ink from the rear surface side to the supply chamber 28.

Further, in FIGS. 4 and 5, within the supply chamber 28, for the respective nozzles 27, cylindrical nozzle filters 38 for removing dust in the ink in the nozzles are provided between the element substrate 11 and the orifice substrate 12 at positions adjacent to the supply port 36. The nozzle filters 38 are disposed at positions spaced apart from the supply port by about 20 μm, for example. Further, a distance between the nozzle filters 38 within the supply chamber 28 is about 10 μm, for example. Due to the presence of the nozzle filters 38, the dirt can be prevented from clogging the supply paths 32 and the discharge ports 26, thereby ensuring the good discharging operation.

Regarding the liquid discharge head having the above-mentioned construction, an operation for discharging the ink droplet from the discharge port 26 will be explained.

First of all, in the liquid discharge head 1, the ink supplied from the supply port 36 to the supply chamber 28 is supplied to the respective nozzles 27 of the first nozzle array 16 and the second nozzle array 17, respectively. The ink supplied to each nozzle 27 is shifted (flowed) along the supply path 32 to fill the bubbling chamber 31. The ink filled in the bubbling chamber 31 is film-boiled by the heater 20 to generate the bubble, with the result that the ink is flown by the growing pressure of the bubble in a direction substantially perpendicular to the main surface of the element substrate 11 thereby to be discharged from the discharge port 26*a* of the discharge port portion 26 as the ink droplet.

When the ink filled in the bubbling chamber 31 is discharged through the second bubbling chamber 31*b* by the growing pressure of the bubble generated by the film boiling caused by the heater 20 within the first bubbling chamber 31*a*, since the second bubbling chamber 31*b* has the conical shape and the side wall thereof is reduced or converged toward the discharge port with the inclination of 10 to 40 degrees with respect to the plane perpendicular to the main surface of the element substrate and the upper surface thereof is communicated with the opening of the discharge port portion 26 via the stepped portion, the ink is straightened while gradually decreasing the ink volume along the direction directing from the element substrate 11 toward the discharge port 26*a*, so that, in the vicinity of the discharge port 26*a*, when the liquid droplet is flying, the flying liquid droplet is directed to a direction perpendicular to the substrate.

When the ink filled in the bubbling chamber 31 is discharged, a part of the ink in the bubbling chamber 31 is shifted toward the supply path 32 by the pressure of the bubble generated in the bubbling chamber 31. In the liquid discharge head 1, when the part of the ink in the bubbling chamber 31 is shifted toward the supply path 32, since the flow path of the supply path 32 is restricted by the control portion 33, the control portion 33 acts as fluid resistance against the ink shifted from the bubbling chamber 31 toward the supply chamber 28 through the supply path 32. Accordingly, in the liquid discharge head 1, since the ink filled in the bubbling chamber 31 is suppressed from shifting toward the supply path 32 by the control portion 33, the ink in the bubbling chamber 31 is prevented from being decreased, so that the discharging volume of the ink is maintained in the good manner, with the result that the discharging volume of the liquid droplet discharged from the discharge port is prevented from being dispersed, thereby maintaining the discharging volume properly.

In this liquid discharge head 1, in a case where it is assumed that the inertance from the heater 20 to the discharge port 26 is $A_1$, the inertance from the heater 20 to the supply port 36 is $A_2$ and the entire inertance of the nozzle 27 is $A_0$, an energy dispensing ratio $\eta$ of the head toward the discharge port 26*a* is represented by the following equation:

$$\eta=(A_1/A_0)=\{A_2/(A_1+A_2)\} \quad (9)$$

Further, the various inertance values can be sought by a Laplace equation, for example, by using three-dimensional limited element method solver.

From the above equation, in the liquid discharge head 1, the energy dispensing ratio $\eta$ of the head toward the discharge port 26*a* is set to 0.59. The liquid discharge head 1 can maintain values of the discharging speed and the discharging volume to values similar to those in the conventional head by substantially equalizing the energy dispensing ratio $\eta$ to that in the conventional liquid discharge head. Also, it is desirable to enable the energy distribution ratio to satisfy the relations of $0.5<\eta<0.8$. In the liquid discharge head 1, if the energy dispensing ratio $\eta$ is 0.5 or less, the good discharging speed and discharging volume cannot be maintained; whereas, if the energy dispensing ratio is 0.8 or more, the ink cannot be shifted properly, and, thus, the refill cannot be achieved.

Further, in the liquid discharge head 1, in a case where black ink of dye type (having surface tension of $47.8\times10^{-3}$ N/m, viscosity of 1.8 cp and PH of 9.8) is used as the ink, in comparison with the conventional liquid discharge head, the viscosity resistance value B in the nozzle 27 can be reduced by about 40%. The viscosity resistance value B can also be calculated by the three-dimensional limited element method solver and can easily be calculated by determining the length of the nozzle 27 and the sectional area of the nozzle 27.

That is to say, it is known that the inertance A is in proportion to the length (l) of the nozzle and is in reverse proportion to the mean sectional area (SΔV) of the nozzle.

In the present invention, by reducing the mean sectional area from the heater to the discharge port, it is intended that the ink in the nozzle is discharged from the discharge port as the liquid droplet more stably and efficiently.

Accordingly, in comparison with the conventional liquid discharge head, the liquid discharge head 1 according to the present invention can increase the discharging speed by about 40% and achieve discharging frequency response of about 25 to 30 kHz.

Now, a manufacturing method for manufacturing the liquid discharge head 1 having the above-mentioned construction will be explained briefly with reference to FIGS. 8A to 8E and FIGS. 9A to 9E.

The method for manufacturing the liquid discharge head 1 comprises a first step for forming the element substrate 11, a second step for forming an upper resin layer 41 and a lower resin layer 42 which constitute the ink flow paths on the element substrate 11, respectively, a third step for forming a desired nozzle pattern on the upper resin layer 41, a fourth step for forming inclinations on side surfaces of the resin layers and a fifth step for forming a desired nozzle pattern on the lower resin layer 42.

Then, in the method for manufacturing the liquid discharge head 1, the liquid discharge head 1 is manufactured through a sixth step for forming a coating resin layer 43 constituting the orifice substrate 12 on the upper and lower resin layers 41 and 42, a seventh step for forming the discharge port portions 26 in the coating resin layer 43, an eighth step for forming the supply port 36 in the element substrate 11 and a ninth step for dissolving the upper and lower resin layers 41 and 42.

Figure 9A:
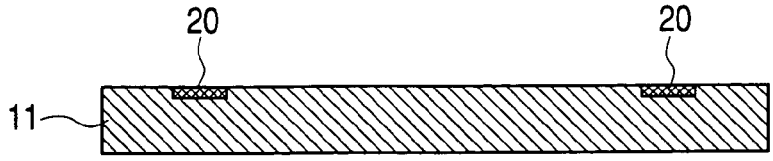
FIGS. 9A, 9B, 9C, 9D and 9E are first longitudinal sectional views for showing and explaining various steps for manufacturing the liquid discharge head according to the first embodiment of the present invention, where

As shown in FIG. 8A and FIG. 9A, the first step is a step for forming the element substrate 11, in which the plural heaters 20 and predetermined wirings for applying voltage to the heaters 20 are provided on a main surface of a silicon chip, for example, by patterning treatment and an insulation film 21 for enhancing the dispersing of accumulated heat is provided to cover the heaters 20 and a protection film 22 is provided to cover the insulation film 21 in order to protect the main surface from cavitation generated when the bubble is extinguished.

Figure 8B:
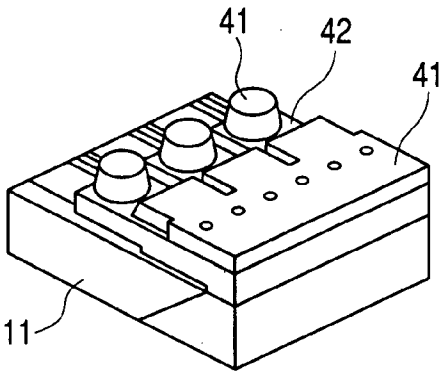
Figure 9B:
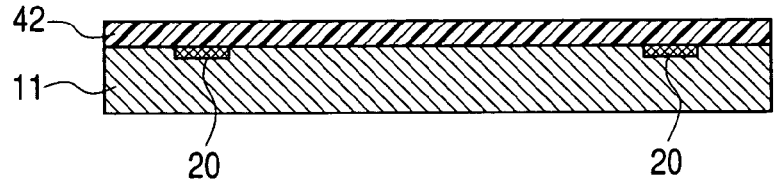
Figure 9C:
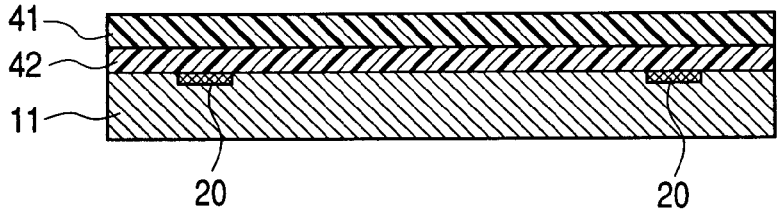

As shown in FIG. 8B and FIGS. 9B and 9C, the second step is a coating step for coating the lower resin layer 42 and the upper resin layer 41 (which are soluble by decomposing the binding between molecules by illuminating Deep-UV (referred to as "DUV" hereinafter) as ultraviolet light having a wavelength smaller than 300 nm onto the element substrate 11) continuously by a spin-coat method. In this coating step, by using a resin material of thermal bridge formation type using dehydro-condensation reaction as the lower resin layer 42, when the upper resin layer 41 is coated by the spin-coat method, mutual melting between the lower resin layer 42 and the upper resin layer 41 is prevented. For the lower resin layer 42, for example, solution obtained by dissolving two-dimensional copolymer (P (MMA-MAA)) =90:10) polymerized by radical polymerization between methyl methacrylate (MMA) and methacrylic acid (MAA) with cyclohexanone solvent is used. Further, for the upper resin layer 41, for example solution obtained by dissolving polymethyl isopropenyl ketone (PMIPK) with cyclohexanone solvent is used. A chemical reaction formula for forming a thermal bridge film by the dehydro-condensation reaction of the two-dimensional copolymer (P (MMA-MAA)) used as the lower resin layer 32 is shown in FIG. 11. In this dehydro-condensation reaction, by performing the heating at a temperature of 180 to 200° C. for 30 minutes to 2 hours, more strong bridge film can be formed. Incidentally, although this bridge film cannot be dissolved by solvent, decomposition reaction as shown in FIG. 11 occurs by illuminating an electron beam such as DUV light onto the film to achieve low molecular structure, with the result that only a portion illuminated by the electron beam can be dissolved by solvent.

Figure 9D:
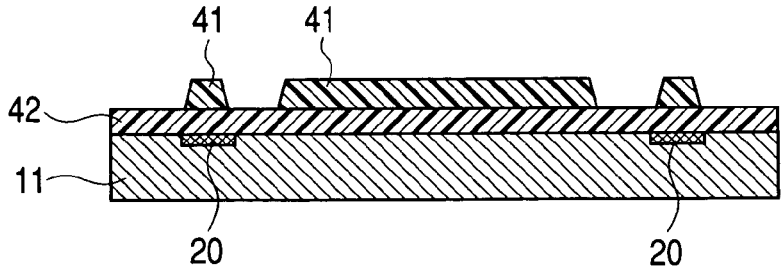

As shown in FIG. 8B and FIG. 9D, the third step is a pattern forming step for forming the desired nozzle pattern on the upper resin layer 41, in which an exposing apparatus for illuminating DUV light is used and a filter for blocking a wavelength below 260 nm is mounted to the exposing apparatus as wavelength selecting means to pass only the wavelength greater than 260 nm so that the desired nozzle pattern is formed by illuminating Near-UV light (referred to as "NUV" hereinafter) having a wavelength of about 260 to 330 nm thereby to expose and develop the upper resin layer 41. In this third step, when the nozzle pattern is formed on the upper resin layer, since a sensitive ratio between the upper resin layer 41 and the lower resin layer 42 regarding the NUV light having the wavelength of about 260 to 330 nm has a difference greater than 40:1, the lower resin layer 42 is not exposed and, thus, P (MMA-MAA) of the lower resin layer 42 is not decomposed. Further, since the lower resin layer 42 is the thermal bridge film, this layer is not dissolved by developing liquid for developing the upper resin layer. Absorption spectrum curves of materials of the lower resin layer 42 and the upper resin layer 41 in a wavelength area of 210 to 330 nm are shown in FIG. 12.

In the fourth step, as shown in FIG. 8B and FIG. 9D, by heating the pattern-formed upper resin layer 41 at a temperature of 140° C. for 5 to 20 minutes, inclinations angled by 10 to 40 degrees can be formed on the side surfaces of the upper resin layer. This inclination angle is associated with the pattern volume (configuration, film thickness) and the heating temperature and time, so that the inclination can be controlled to have a designated angle within the above-mentioned angle range.

Figure 9E:
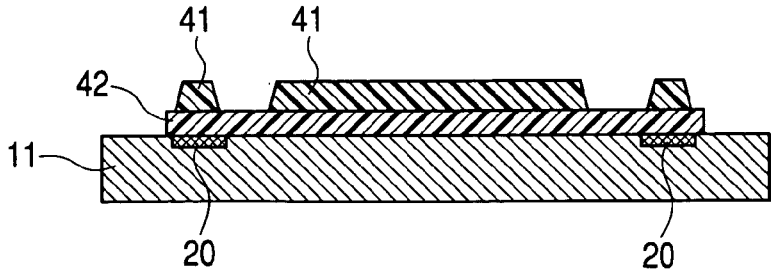

As shown in FIG. 8B and FIG. 9E, the fifth step is a pattern forming step for forming the desired nozzle pattern on the lower resin layer 42 by illuminating DUV light having a wavelength of 210 to 330 nm by means of the exposing apparatus to expose and develop the lower resin layer. Further, P (MMA-MAA) material used in the lower resin layer 42 has a high resolving power and, even when the thickness is about 5 to 20 μm, the inclination angle at the side wall can be formed as a trench structure of 0 to 5 degrees. Further, if desired, further inclinations can also be formed on side walls of the lower resin layer 42 by heating the pattern-formed resin layer 42 at a temperature of 120 to 140° C.

As shown in FIG. 10A, the sixth step is a coating step for coating the transparent coating resin layer 43 constituting the orifice substrate 12 on the upper resin layer 41 and the lower resin layer 42 on which the nozzle patterns were formed and which can be dissolved by decomposing the bridge coupling between the molecules by means of the DUV light.

Figure 8C:
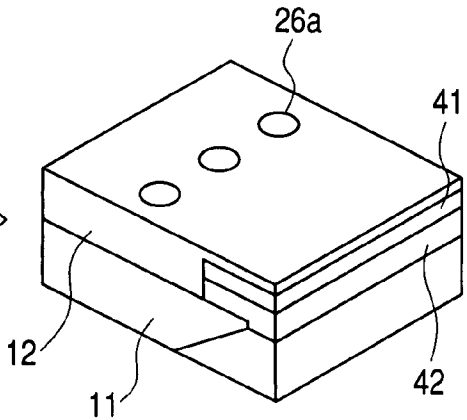

As shown in FIG. 8C and FIG. 10B, in the seventh step, the orifice substrate 12 is formed by removing resin from portions corresponding to the discharge port portions 26 by exposure and development performed by illuminating UV light onto the coating resin layer 43 by means of the exposing apparatus. It is desirable that the inclination of the side wall of the discharge port portion formed in the orifice substrate 12 is formed to have an angle of about 0° as less as possible with respect to the plane perpendicular to the main surface of the element substrate. However, so long as such inclination is 0 to 10 degrees, there is no problem regarding the liquid droplet discharging property.

Figure 8D:
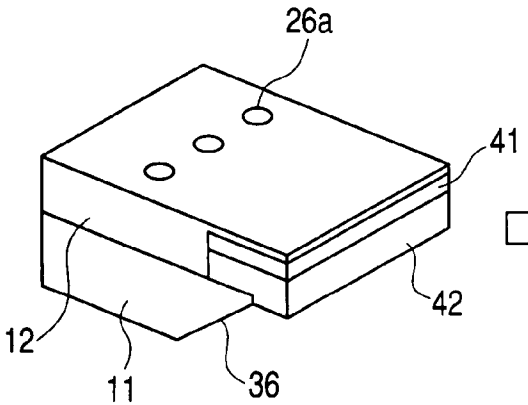

As shown in FIG. 8D and FIG. 10C, in the eighth step, the supply port 36 is formed in the element substrate 11 by performing chemical etching on the rear surface of the element substrate 11. As the chemical etching, for example, anisotropic etching utilizing strong alkali solution (KOH, NaOH, TMAH) can be used.

Figure 8E:
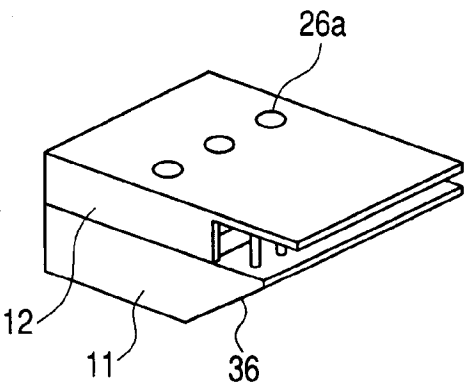

As shown in FIG. 8E and FIG. 10D, in the ninth step, by illuminating DUV light having a wavelength smaller than 330 nm to pass through the coating resin layer 43 from the main surface side of the element substrate 11, the upper and lower resin layers 41 and 42 as nozzle molding materials which are situated between the element substrate 11 and the orifice substrate 12 are flowed out through the supply port 36.

In this way, a chip having the nozzles 27 including the discharge ports 26*a*, the supply port 36 and the step-shaped control portions 33 provided in the supply paths 32 communicating the discharge ports with the supply port can be obtained. By electrically connecting this chip to a wiring substrate (not shown) for driving the heaters 20, the liquid discharge head can be obtained.

Incidentally, according to the above-mentioned method for manufacturing the liquid discharge head 1, by producing the upper resin layer 41 and the lower resin layer 42 which can be dissolved by decomposing the bridge coupling between the molecules by means of the DUV light as a further laminated structure with respect to a thickness direction of the element substrate 11, it is possible to provide a control portion having three or more stepped portions within the nozzle 27. For example, a multi-stage nozzle structure can be formed by using resin material having sensitivity to light having a wavelength of 400 nm or more as an upper layer on the upper resin layer.

It is preferable that the method for manufacturing the liquid discharge head 1 according to the present invention fundamentally applies correspondingly to a method for manufacturing a liquid discharge head using the ink jet recording method disclosed in Japanese Patent Application Laid-Open Nos. 4-10940 and 4-10941 as ink discharging means. These patent documents disclose an ink droplet discharging method having a construction in which a bubble generated by a heater is communicated with atmosphere and propose a liquid discharge head capable of discharging an ink droplet having a small amount of 50 pl or less, for example.

In the liquid discharge head 1, since the bubble is communicated with the atmosphere, the volume of the ink droplet discharged from the discharge port 26*a* greatly depends upon the volume of the ink positioned between the heater 20 and the discharge port 26*a*, i.e. the volume of the ink filled in the bubbling chamber 31. In other words, the volume of the discharged ink droplet is substantially determined by a structure of the bubbling chamber 31 of the nozzle 27 of the liquid discharge head 1.

Accordingly, the liquid discharge head 1 can output a high quality image having no ink unevenness. When the liquid discharge head 1 according to the present invention is applied to a liquid discharge head in which a minimum distance between a heater and a discharge port is smaller than 30 μm in order to communicate a bubble with atmosphere in construction, the greatest effect can be achieved. However, so long as the liquid discharge head is designed so that the ink droplet is flown in the direction perpendicular to the main surface of the element substrate on which the heaters are provided, excellent effect can be achieved.

As mentioned above, in the liquid discharge head 1, by providing the second bubbling chamber 31*b* having the conical shape, the ink is straightened while gradually decreasing the volume of the ink along the direction extending from the element substrate 11 to the discharge port 26*a*, and, in the vicinity of the discharge port 26*a*, when the liquid droplet is flying, the flying liquid droplet is directed toward the direction perpendicular to the element substrate 11. Further, since the control portion 33 for controlling the flow of the ink in the bubbling chamber 31 is provided, the volume of the discharged ink droplet is stabilized, thereby enhancing the ink droplet discharging efficiency.

SECOND EMBODIMENT

In the first embodiment, while an example that the second bubbling chamber 31*b* having the conical shape is formed above the first bubbling chamber 31*a* and the inclination of the side wall of the second bubbling chamber is converged toward the discharge port portion 26 with the angle of 10 to 45 degrees with respect to the plane perpendicular to the main surface of the element substrate 11 was explained, in a second embodiment of the present invention, a liquid discharge head 2 in which the ink filled in the bubbling chamber is apt to be shifted toward the discharge port will be explained. Incidentally, the same elements as those in the liquid discharge head 1 are designated by the same reference numerals and explanation thereof will be omitted.

In the liquid discharge head 2 according to the second embodiment, similar to the first embodiment, each bubbling chamber 56 includes a first bubbling chamber 56*a* in which a bubble is generated by a heater 20 and a second bubbling chamber 56*b* disposed on the way from the first bubbling chamber 56*a* to a discharge port portion 53 and, inclination of a side wall of the second bubbling chamber 56*b* is converged toward the discharge port portion 53 with an angle of 10 to 45 degrees with respect to a plane perpendicular to a main surface of an element substrate 11, and, further, in the first bubbling chambers 56*a*, wall surfaces provided for independently distinguishing the plural first bubbling chambers 56*a* are converged toward the discharge ports with an angle of 0 to 10 degrees with respect to the plane perpendicular to the main surface of the element substrate 11, and, in the discharge port portions 53, the wall surfaces are converged toward the discharge ports 53*a* with an angle of 0 to 5 degrees with respect to the plane perpendicular to the main surface of the element substrate 11.

As shown in FIGS. 13 and 14, an orifice substrate 52 of the liquid discharge head 2 is formed from resin material to have a thickness of about 30 μm. As explained early with reference to FIG. 1, the orifice substrate 52 includes a plurality of discharge ports 53*a* for discharging the ink droplet and a plurality of nozzles 54 through which the ink is shifted and supply chambers 55 for supplying the ink to the nozzles 54.

Each nozzle 54 includes the discharge port portion 53 having the discharge port 53*a* for discharging the liquid droplet, the bubbling chamber 56 in which the bubble is generated in the liquid by means of the heater 20 as discharge energy generating means and a supply path 57 for supplying the liquid to the bubbling chamber 56.

The bubbling chamber 56 comprises the first bubbling chamber 56*a* which is communicated with the supply path 57 has a bottom surface constituted by the main surface of the element substrate 11 and in which the bubble is generated in the liquid by the heater 20 and the second bubbling chamber 56*b* which is communicated with an opening of an upper surface parallel with the main surface of the element substrate 11 and in which the bubble generated in the first bubbling chamber 56*a* is growing and, the discharge port portion 53 is communicated with an opening of an upper surface of the second bubbling chamber 56*b* and, a stepped portion is provided between a side wall surface of the discharge port portion 53 and a side wall surface of the second bubbling chamber 56*b*.

The discharge port 53*a* is provided at a position opposed to the corresponding heater 20 on the element substrate 11 and is a circular hole having a diameter of about 15 μm, for example. Incidentally, the discharge port 53*a* may be formed as a radial substantially star-shape in dependence upon requirement of the discharging property.

The first bubbling chamber 56*a* is designed so that the bottom surface thereof opposed to the discharge port 53*a* becomes substantially rectangular. Further, the first bubbling chamber 56*a* is designed so that a minimum distance OH between a main surface of the heater 20 parallel with the main surface of the element substrate 11 and the discharge port 53*a* becomes smaller than 30 μm. As explained early with reference to FIG. 1, the plural heaters 20 are provided on the element substrate 11 and, in a case where arrangement density is 600 dpi, the pitch between the heaters becomes about 42.5 μm. In a case where a width of the first bubbling chamber 56*a* in a heater arranging direction is 35 μm, a width of a nozzle wall partitioning the heaters becomes about 7.5 μm. A height of the first bubbling chamber 56*a* from the surface of the element substrate 11 is 10 μm. A height of the second bubbling chamber 56*b* formed above the first bubbling chamber 56*a* is 15 μm and a height of the discharge port portion 53 formed in the orifice substrate 52 is 5 μm. The configuration of the discharge port 53*a* is circular and has a diameter of 15 μm. The configuration of the second bubbling chamber 56*b* is conical and, in a case where a diameter of a bottom surface thereof contiguous to the first bubbling chamber 56*a* is 30 μm, when the inclination of 20° is formed on the side wall of the second bubbling chamber, a diameter of the upper surface near the discharge port portion 53 becomes 19 μm. The second bubbling chamber is connected to the discharge port portion 53 having a diameter of 15 μm via a stepped portion of about 2 μm.

In a case where the discharge port portion is formed above the second bubbling chamber, since manufacturing tolerance is generated, such a stepped portion is provided as design size for stably communicating the second bubbling chamber with the discharge port portion. Thus, it is not necessary that a central axis of the discharge port portion coincides with a central axis of the upper surface of the second bubbling chamber.

The bubble generated in the first bubbling chamber 56*a* is growing toward the second bubbling chamber 56*b* and the supply path 57, so that the ink filled in the nozzle 54 is straightened at the discharge port portion 53 and is discharged or flown from the discharge port 53*a* of the orifice substrate.

The supply path 57 has one end communicated with the bubbling chamber 56 and the other end communicated with the supply chamber 55.

Since the greater inclination is provided on the side wall of the second bubbling chamber 56*a* and the inclination is also provided on the first bubbling chamber 56*a*, by the bubble generated in the first bubbling chamber 56*a*, the ink filled in the nozzle can be shifted toward the discharge port portion 53 more efficiently. However, although all of the first bubbling chamber 56*a*, second bubbling chamber 56*b* and discharge port portion 53 are formed by a photo-lithography process with high accuracy, these are not formed without mis-alignment completely, and, thus, alignment error of sub micron level will occur. Thus, in order to fly the ink droplet straightly toward the direction perpendicular to the main surface of the element substrate 11, at the discharge port portion 53, it is required that the flying direction of the ink be straightened correctly. To this end, it is desirable that the inclination of the side wall of the discharge port portion 53 is parallel with the direction perpendicular to the main surface of the element substrate 11, i.e. 0° as less as possible.

However, in order to make the flying ink droplet smaller, the opening area of the discharge port must be made smaller, with the result that, if the height (length) of the discharge port portion 53 becomes great in comparison with the opening, since the viscosity resistance of the ink at that portion is increased greatly, the discharging property of the flying ink droplet may be worsened. To avoid this, in the liquid discharge head 2 according to the second embodiment, it is designed so that the bubble generated in the first bubbling chamber is more apt to be grown to the second bubbling chamber and the ink filled in the nozzle is apt to be shifted in the second bubbling chamber and the discharging direction of the flying ink droplet can be straightened. Although depending upon the distance from the surface of the element substrate 11 to the discharge port 53*a*, the height of the second bubbling chamber is desirably about 3 to 25 μm and more desirably about 5 to 15 μm. Further, the length of the discharge port portion 53 is desirably about 1 to 10 μm and more desirably about 1 to 3 μm.

Further, as shown in FIG. 13, the nozzle 54 has a straight shape in which a width of the flow path perpendicular to the ink flowing direction and parallel with the main surface of the element substrate 11 is substantially constant from the supply chamber 55 to the bubbling chamber 56. Further, in the nozzle 54, the inner wall surface opposed to the main surface of the element substrate 11 is formed to be in parallel with the main surface of the element substrate 11 from the supply chamber 55 to the bubbling chamber 56.

Regarding the liquid discharge head 2 having the above-mentioned construction, an operation for discharging the ink from the discharge port 53*a* will now be explained.

First of all, in the liquid discharge head 2, the ink supplied from the supply port 36 to the supply chamber 55 is supplied to the respective nozzles 54 of the first nozzle array and the second nozzle array, respectively. The ink supplied to each nozzle 54 is shifted along the supply path 57 to fill the bubbling chamber 56. The ink filled in the bubbling chamber 56 is film-boiled by the heater 20 to generate the bubble, with the result that the ink is flown by the growing pressure of the bubble in a direction substantially perpendicular to the main surface of the element substrate 11 thereby to be discharged from the discharge port 53*a* as the ink droplet.

When the ink filled in the bubbling chamber 56 is discharged, a part of the ink in the bubbling chamber 56 is shifted toward the supply path 57 by the pressure of the bubble generated in the bubbling chamber 56. In the liquid discharge head 2, the pressure of the bubble generated in the first bubbling chamber 56*a* is also transferred to the second bubbling chamber 56*b* instantaneously, so that the ink filled in the first bubbling chamber 56*a* and the second bubbling chamber 56*b* is shifted within the second bubbling chamber 56*b*. In this case, since the inner walls are inclined, the bubble growing in the first bubbling chamber 56*a* and the second bubbling chamber 56*b* abuts against the inner walls to minimize the pressure loss and is growing effectively toward the discharge port 53*a*. The ink straightened at the discharge port portion 53 is flown from the discharge port 53*a* of the orifice substrate 52 toward the direction perpendicular to the main surface of the element substrate 11. Further, the discharging volume of the ink droplet is also ensured effectively. Accordingly, the liquid discharge head 2 can increase the discharging speed of the ink droplet discharged from the discharge port 53*a*.

Therefore, in the liquid discharge head 2, since the dynamic energy of the ink droplet calculated from the discharging speed and the discharging volume is enhanced in comparison with the conventional liquid discharge head, the discharging efficiency can be enhanced and, similar to the above-mentioned liquid discharge head 1, the discharging frequency property can be improved.

Now, a method for manufacturing the liquid discharge head 2 having the above-mentioned construction will be explained briefly. Since the method for manufacturing the liquid discharge head 2 is the substantially the same as the above-mentioned method for manufacturing the liquid discharge head 1, the same elements are designated by the same reference numerals and explanation of the same steps will be omitted.

As shown in FIG. 8A and FIG. 9A, the first step is a substrate forming step for forming the element substrate 11 by providing the plural heaters 20 and predetermined wirings for applying voltage to the heaters 20 on a silicon chip, for example, by patterning treatment.

As shown in FIG. 8B and FIGS. 9B and 9C, the second step is a coating step for coating the lower resin layer 42 and the upper resin layer 41 (which are soluble by decomposing the binding between molecules by illuminating DUV light having a wavelength smaller than 330 nm onto the element substrate 11) continuously by a spin-coat method. Film thicknesses of lower resin layer 42 and of upper resin layer 41 are 10 μm and 15 μm, respectively.

As shown in FIG. 8B and FIG. 9D, the third step is a pattern forming step for forming the desired nozzle pattern on the upper resin layer 41, in which an exposing apparatus for illuminating DUV light is used and a filter for blocking a wavelength below 260 nm is mounted to the exposing apparatus as wavelength selecting means to pass only the wavelength greater than 260 nm so that the desired nozzle pattern is formed by illuminating NUV light having a wavelength of about 260 to 330 nm thereby to expose and develop the upper resin layer 41.

In the fourth step, as shown in FIG. 8B and FIG. 9D, by heating the pattern-formed upper resin layer 41 at a temperature of 140° C. for 10 minutes, inclinations angled by 20 degrees is formed on the side surfaces of the upper resin layer.

As shown in FIG. 8B and FIG. 9E, the fifth step is a pattern forming step for forming the desired nozzle pattern on the lower resin layer 42 by illuminating DUV light having a wavelength of 210 to 330 nm by means of the exposing apparatus to expose and develop the lower resin layer.

As shown in FIG. 10A, the sixth step is a coating step for coating the transparent coating resin layer 43 constituting the orifice substrate 12 on the upper resin layer 41 and the lower resin layer 42 on which the nozzle patterns were formed and which can be dissolved by decomposing the bridge coupling between the molecules by means of the DUV light. A thickness of coating resin layer 43 is 30 μm.

As shown in FIG. 8C and FIG. 10B, in the seventh step, the orifice substrate 12 is formed by removing resin from portions corresponding to the discharge port portions 53 by exposure and development performed by illuminating UV light onto the coating resin layer 43 by means of the exposing apparatus. A film thickness of coating resin layer 43 is 30 μm As shown in FIG. 8D and FIG. 10C, in the eighth step, the supply port 36 is formed in the element substrate 11 by performing chemical etching on the rear surface of the element substrate 11. As the chemical etching, for example, anisotropic etching utilizing strong alkali solution (KOH, NaOH, TMAH) can be used.

As shown in FIG. 8E and FIG. 10D, in the ninth step, by illuminating DUV light having a wavelength smaller than 330 nm to pass through the coating resin layer 43 from the main surface side of the element substrate 11, the upper and lower resin layers 41 and 42 as nozzle molding materials which are situated between the element substrate 11 and the orifice substrate 12 are flowed out through the supply port 36.

In this way, a chip having the nozzles 54 including the discharge ports 53*a*, the supply port 36 and the step-shaped control portions 58 provided in the supply paths 57 communicating the discharge ports with the supply port can be obtained. By electrically connecting this chip to a wiring substrate (not shown) for driving the heaters 20, the liquid discharge head 2 can be obtained.

As mentioned above, in the liquid discharge head 2, by providing the second bubbling chamber 56*b* having the conical shape and by providing the inclination on the wall surface of the first bubbling chamber 56*a*, the ink is straightened while gradually decreasing the volume of the ink along the direction extending from the element substrate 11 to the discharge port 53*a*, and, in the vicinity of the discharge port 53*a*, when the liquid droplet is flying, the flying liquid droplet is directed toward the direction perpendicular to the element substrate 11. Further, since the control portion 58 for controlling the flow of the ink in the bubbling chamber 56 is provided, the volume of the discharged ink droplet is stabilized, thereby enhancing the ink droplet discharging efficiency.

THIRD EMBODIMENT

Now, a liquid discharge head 3 according to a third embodiment of the present invention in which the height of the first bubbling chamber of the above-mentioned liquid discharge head 2 is further decreased and the height of the second bubbling chamber is increased will be explained briefly with reference to the accompanying drawings. The same elements as those in the liquid discharge heads 1 and 2 are designated by the same reference numerals and explanation thereof will be omitted.

In the liquid discharge head 3 according to the third embodiment, similar to the first embodiment, each bubbling chamber 66 includes a first bubbling chamber 66*a* in which a bubble is generated by a heater 20 and a second bubbling chamber 66*b* disposed on the way from the first bubbling chamber 66*a* to a discharge port portion 63 and, inclination of a side wall of the second bubbling chamber 66*b* is converged toward the discharge port portion 63 with an angle of 10 to 45 degrees with respect to a plane perpendicular to a main surface of an element substrate 11, and, further, in the first bubbling chambers 66*a*, wall surfaces provided for independently distinguishing the plural first bubbling chambers 66*a* are converged toward the discharge ports with an angle of 0 to 10 degrees with respect to the plane perpendicular to the main surface of the element substrate 11, and, in the discharge port portions 63, the wall surfaces are converged toward the discharge ports 63*a* with an angle of 0 to 5 degrees with respect to the plane perpendicular to the main surface of the element substrate 11.

As shown in FIGS. 15 and 16, an orifice substrate 62 of the liquid discharge head 3 is formed from resin material to have a thickness of about 30 μm. As explained early with reference to FIG. 1, the orifice substrate 62 includes a plurality of discharge ports 63*a* for discharging the ink droplet and a plurality of nozzles 64 through which the ink is shifted and supply chambers 65 for supplying the ink to the nozzles 64.

The discharge port 63*a* is provided at a position opposed to the corresponding heater 20 on the element substrate 11 and is a circular hole having a diameter of about 15 μm, for example. Incidentally, the discharge port 63*a* may be formed as a radial substantially star-shape in dependence upon requirement of the discharging property.

The first bubbling chamber 66*a* is designed so that the bottom surface thereof opposed to the discharge port 63*a* becomes substantially rectangular. Further, the first bubbling chamber 66*a* is designed so that a minimum distance OH between a main surface of the heater 20 parallel with the main surface of the element substrate 11 and the discharge port 63*a* becomes smaller than 30 μm. A height of an upper surface of the first bubbling chamber 66*a* from the surface of the element substrate 11 is 8 μm, for example, and a height of the second bubbling chamber 66*b* formed above the first bubbling chamber 66*a* is 18 μm. The second bubbling chamber 66*b* has a quadrangular pyramid shape and a length of a side near the first bubbling chamber 66*a* is 28 μm and R of 2 μm is formed at each corner. Side walls of the second bubbling chamber 66*b* have inclinations of 15° with respect to the plane perpendicular to the main surface of the element substrate 11 so that the side walls are converged toward the discharge port portion 63. The second bubbling chamber 66*b* is communicated with the discharge port portion 63 having a diameter of 15 μm via steps of about 1.7 μm at least.

A height of the discharge port portion 63 formed in the orifice substrate 62 is 4 μm. The configuration of the discharge port 63*a* is circular and has a diameter of 15 μm.

The bubble generated in the first bubbling chamber 66*a* is growing toward the second bubbling chamber 66*b* and the supply path 67, so that the ink filled in the nozzle 64 is straightened at the discharge port portion 63 and is discharged or flown from the discharge port 63*a* of the orifice substrate 62.

The supply path 67 has one end communicated with the bubbling chamber 66 and the other end communicated with the supply chamber 65.

The first bubbling chamber 66*a* is formed on the element substrate. By decreasing the height of the first bubbling chamber, a sectional area of the ink flow path is made smaller from one end of the supply path 67 adjacent to the first bubbling chamber 66*a* to the first bubbling chamber 66*a*, so that the sectional area is decreased in comparison with the liquid discharge head 2 according to the second embodiment.

On the other hand, by increasing the height of the second bubbling chamber 66*b*, the pressure of the bubble generated in the first bubbling chamber 66*a* is apt to be transferred to the second bubbling chamber 66*b* and is hard to be transferred from the first bubbling chamber 66*a* to the supply path 67 communicated with the first bubbling chamber, so that the ink can be shifted to the discharge port portion 63 quickly and efficiently.

Further, the nozzle 64 has a straight shape in which a width of the flow path perpendicular to the ink flowing direction and parallel with the main surface of the element substrate 11 is substantially constant from the supply chamber 65 to the bubbling chamber 66. Further, in the nozzle 64, the inner wall surface opposed to the main surface of the element substrate 11 is formed to be in parallel with the main surface of the element substrate 11 from the supply chamber 65 to the bubbling chamber 66.

Regarding the liquid discharge head 3 having the above-mentioned construction, an operation for discharging the ink from the discharge port 63*a* will now be explained.

First of all, in the liquid discharge head 3, the ink supplied from the supply port 36 to the supply chamber 65 is supplied to the respective nozzles 64 of the first nozzle array and the second nozzle array, respectively. The ink supplied to each nozzle 64 is shifted along the supply path 67 to fill the bubbling chamber 66. The ink filled in the bubbling chamber 66 is film-boiled by the heater 20 to generate the bubble, with the result that the ink is flown by the growing pressure of the bubble in a direction substantially perpendicular to the main surface of the element substrate 11 thereby to be discharged from the discharge port 63*a* as the ink droplet.

When the ink filled in the bubbling chamber 66 is discharged, a part of the ink in the bubbling chamber 66 is shifted toward the supply path 67 by the pressure of the bubble generated in the bubbling chamber 66. In the liquid discharge head 3, when the part of the ink in the first bubbling chamber 66*a* is shifted toward the supply path 67, since the height of the first bubbling chamber 66*a* is reduced to restrict the flow path of the supply path 67, the fluid resistance value of the flow path of the supply path 67 is increased with respect to the ink flowing from the first bubbling chamber 66*a* through the supply path 67 toward the supply chamber 65. Accordingly, in the liquid discharge head 3, since the ink filled in the bubbling chamber 66 is suppressed from flowing toward the supply path 67, the growth of the bubble from the first bubbling chamber 66*a* to the second bubbling chamber 66*b* is further promoted, fluidity of the ink toward the discharge port is enhanced, thereby ensuring the discharging volume of the ink further efficiently.

Further, in the liquid discharge head 3, the pressure of the bubble transferred from the first bubbling chamber 66*a* to the second bubbling chamber 66*b* becomes further effective and, since the wall surfaces of the first bubbling chamber 66*a* and the second bubbling chamber 66*b* are inclined, the bubble growing within the first bubbling chamber 66*a* and the second bubbling chamber 66*b* abuts against the inner walls of the bubbling chamber 66 to minimize the pressure loss, thereby growing the bubble effectively. Accordingly, in the liquid discharge head 3, the discharging speed of the ink discharged from the discharge port 63*a* is increased.

According to the above-mentioned liquid discharge head 3, the ink can be moved quickly with less resistance within the first bubbling chamber 66*a* and the second bubbling chamber 66*b* and, since the length of the discharge port portion is decreased, the straightening action of the ink can be performed more quickly in comparison with the liquid discharge heads 1 and 2, thereby further enhancing the discharging efficiency of the ink droplet.

FOURTH EMBODIMENT

In the above-mentioned liquid discharge heads 1, 2 and 3, while an example that the first nozzle array 16 and the second nozzle array 17 are formed similarly was explained, lastly, a liquid discharge head 4 according to a fourth embodiment of the present invention in which configurations of first and second nozzle arrays and areas of heaters are different from each other will be explained with reference to the accompanying drawings.

As shown in FIGS. 17A and 17B, first and second heaters 98 and 99 having different areas parallel to a main surface of an element substrate are provided on the element substrate 96 of the liquid discharge head 4.

Further, in an orifice substrate 97 of the liquid discharge head 4, opening areas of discharge ports 106 and 107 of first and second nozzle arrays 101 and 102 and configurations of the nozzles are different from each other. Each of the discharge ports 106 in the first nozzle array 101 is a circular hole. Since the nozzles in the first nozzle array 101 are the same as those in the above-mentioned liquid discharge head 2, explanation thereof will be omitted. However, in order to improve the movement of ink in a bubbling chamber, a second bubbling chamber 109 is formed above a first bubbling chamber. Further, each of the discharge ports 107 in the second nozzle array 102 has a radial substantially star shape. Each of the nozzles in the second nozzle array 102 has a straight shape so that a sectional area of an ink flow path is not changed from the bubbling chamber to the discharge port.

Further, the element substrate 96 is provided with a supply port 104 for supplying the ink to the first nozzle array 101 and the second nozzle array 102.

By the way, the flow of the ink in the nozzle is caused by a volume Vd of the ink droplet flown from the discharge port and an action for restoring a meniscus after the ink droplet was flown is performed by a capillary force generated in accordance with an opening area of the discharge port. In a case where it is assumed that the opening area of the discharge port is $S_0$, an outer periphery of an opening edge of the discharge port is $L_1$, surface tension of the ink is $\gamma$ and a contact angle between the ink and an inner wall of the nozzle is $\theta$, the capillary force p is represented by the following equation:

$$P=\gamma \cos \theta \times L_1/S_0$$

Further, in a case where it is assumed that the meniscus is generated only by the volume Vd of the ink droplet flown and is restored after discharge frequency time t (refill time t), the following relationship is established:

$$p=B\times(Vd/t)$$

According to the liquid discharge head 4, in the first nozzle array 101 and the second nozzle array 102, since the areas of the first and second heaters 98 and 99 and the opening areas of the discharge ports 106 and 107 differ from each other, the ink droplets having different discharging volumes can be discharged from the single liquid discharge head 4.

Further, in the liquid discharge head 4, surface tension, viscosity and pH which are material property values of the inks discharged from the first nozzle array 101 and the second nozzle array 102 are identical and, by setting physical values such as inertance A and viscosity resistance B in accordance with the discharging volumes of the ink droplets discharged from the discharge ports 106 and 107 in correspondence to the structures of the nozzles, it is possible to substantially equalize the discharge frequency response of the first nozzle array 101 to the discharge frequency response of the second nozzle array 102.

That is to say, in the liquid discharge head 4, for example, in a case where it is assumed that discharged amounts of the ink droplets discharged from the first nozzle array 101 and the second nozzle array 102 are 4.0 (pl) and 1.0 (pl), respectively, the fact that the refill times of the nozzle arrays 101 and 102 are made substantially equal means the fact that a ratio $L_1/S_0$ between the outer periphery $L_1$ of each of the opening edges of the discharge ports 106 and 107 and the opening area $S_0$ of each of the discharge ports 106 and 107 is equalized to the viscosity resistance B.

Now, a method for manufacturing the liquid discharge head 4 having the above-mentioned construction will be explained with reference to the accompanying drawings.

The method for manufacturing the liquid discharge head 4 applies accordingly to the above-mentioned methods for manufacturing the liquid discharge heads 1 and 2 and, steps except for the pattern forming steps for forming the nozzle patterns on the upper resin layer 41 and the lower resin layer 42 are the same as those of the aforementioned manufacturing methods. In the method for manufacturing the liquid discharge head 4, in a pattern forming step, as shown in FIGS. 18A, 18B and 18C, after the upper and lower resin layers 41 and 42 were formed on the element substrate 96, as shown in FIGS. 18D and 18E, desired nozzle patterns for the first and second nozzle arrays 101 and 102 are formed, respectively. That is to say, the nozzle patterns for the first and second nozzle arrays 101 and 102 are formed asymmetrically with respect to the supply port 104. Namely, in the method for manufacturing the liquid discharge head 4, merely by partially changing the nozzle patterns on the upper and lower resin layers 41 and 42, the liquid discharge head 4 can easily be manufactured. Since further steps shown in FIGS. 19A to 19D are the same as those in the first embodiment, explanation thereof will be omitted.

According to the above-mentioned liquid discharge head 4, by providing the nozzle structures for the first and second nozzle arrays which are different from each other, it is possible to discharge the ink droplets having different discharging volumes for the nozzle arrays 101 and 102 and the ink droplet can easily discharged stably with the optimum discharging frequency at a high speed.

Further, according to the liquid discharge head 4, by adjusting balance of the fluidity resistance obtained by the capillary force, when a recovery operation is performed by a recovery mechanism, the ink can be sucked uniformly and quickly and, since the recovery mechanism can be simplified, reliability of the discharging property of the liquid discharge head can be enhanced and, a recording apparatus having improved reliability of the recording operation can be provided.

As mentioned above, according to the liquid discharge head of the present invention, the bubble generated in the first bubbling chamber is growing into the second bubbling chamber so that the ink in the second bubbling chamber is discharged through the second bubbling chamber and the discharge port portion as the ink droplet. In this case, the discharging amount of the ink droplet is stabilized, thereby enhancing the discharging efficiency.

Further, in the liquid discharge head according to the present invention, since the bubble generated in the first bubbling chamber abuts against the inner wall of the second bubbling chamber to minimize the pressure loss, the ink in the bubbling chamber can be moved quickly and efficiently, thereby enhancing the discharging efficiency and increasing the refill speed.

What is claimed is:

1. A liquid discharge head comprising:

a discharge energy generating element for generating energy for discharging a liquid droplet;

an element substrate having a main surface on which said discharge energy generating element is provided;

a discharge port portion having a discharge port for discharging the liquid droplet;

a nozzle having a bubbling chamber in which a bubble is generated in liquid by said discharge energy generating element and a supply path for supplying the liquid to said bubbling chamber;

a supply chamber for supplying the liquid to said nozzle; and an orifice substrate joined to the main surface of said element substrate, wherein said bubbling chamber includes a first bubbling chamber which communicates with said supply path and uses a portion of the main surface of said element substrate as a bottom surface of said first bubbling chamber and in which the bubble is generated in the liquid by said discharge energy generating element and a second bubbling chamber communicating with said first bubbling chamber, said second bubbling chamber communicates with said discharge port portion, a central axis of a lower surface of said second bubbling chamber extending through a center of said lower surface of said second bubbling chamber in a direction perpendicular to said substrate coincides with a central axis of an upper surface of said second bubbling chamber extending through a center of said upper surface of said second bubbling chamber in a direction perpendicular to said substrate, a cross-sectional area of said upper surface with respect to a central axis of said second bubbling chamber extending through the center of said second bubbling chamber in a direction perpendicular to said substrate is smaller than a cross-sectional area of said lower surface with respect to the central axis of said second bubbling chamber, a cross-sectional area of said second bubbling chamber with respect to the central axis of said second bubbling chamber changes continuously from said lower surface to said upper surface of said second bubbling chamber, such that a side wall surface of said second bubbling chamber has an inclination of 10 to 45 degrees with respect to a plane perpendicular to the main surface of said element substrate, and the cross-sectional area of said upper surface with respect to the central axis of said second bubbling chamber is greater than a cross-sectional area of said discharge port portion with respect to a central axis of said discharge port portion.

2. A liquid discharge head according to claim 1, further comprising plural nozzles, wherein said first bubbling chamber is enclosed, in three directions, by nozzle walls for partitioning said plural nozzles arranged in parallel to form individual nozzles and, a wall surface of said discharge port portion is parallel with a line perpendicular to the main surface of said element substrate.

3. A liquid discharge head according to claim 1, further comprising plural nozzles, wherein said first bubbling chamber is enclosed, in three directions, by nozzle walls for partitioning said plural nozzles arranged in parallel to form individual nozzles and, a wall surface of said discharge port portion has a taper of less than 10° with respect to a plane perpendicular to the main surface of said element substrate.

4. A liquid discharge head according to claim 1, wherein an upper surface of said supply path parallel with the main surface of said element substrate near said supply chamber is higher than an upper surface of said supply path contiguous to and flush with an upper surface of said first bubbling chamber and is connected to the latter upper surface via a stepped portion, and a maximum height of said supply path from the main surface of said element substrate to the former upper surface is smaller than a height from the main surface of said element substrate to the upper surface of said second bubbling chamber.

5. A liquid discharge head according to claim 1, wherein a height of said supply path in a plane perpendicular to a flowing direction of the liquid is changed in a thickness direction of said orifice substrate in a vicinity of a stepped portion that connects (a) an upper surface of said supply path parallel with the main surface of said element substrate near said supply chamber with (b) an upper surface of said supply path contiguous to and flush with an upper surface of said first bubbling chamber.

6. A liquid discharge head according to claim 1, wherein said nozzle is designed so that a cross-sectional area of a flow path extending from said discharge port to said supply chamber is changed with plural stages.

7. A liquid discharge head according to claim 1, wherein said nozzle is formed so that a discharging direction along which the liquid droplet is ejected from said discharge port is perpendicular to a flowing direction of the liquid flowing in said supply path.

8. A liquid discharge head according to claim 1, wherein said nozzle is formed so that the sum of volumes of said first bubbling chamber, said second bubbling chamber and said discharge port portion is smaller than a volume of said supply path.

9. A liquid discharge head according to claim 1, wherein the bubble generated by said discharge energy generating element communicates with the atmosphere during the discharging.

10. A liquid discharge head according to claim 1, wherein said orifice substrate is provided with plural nozzles and plural discharge energy generating elements corresponding thereto, respectively, said plural nozzles are divided into a first nozzle array and a second nozzle array which is disposed at a position opposed to said first nozzle array, with said supply chamber being interposed between said first and second nozzle arrays, longitudinal directions of the nozzles in said first nozzle array are parallel, and longitudinal directions of the nozzles in said second nozzle array are parallel, and longitudinal central axes of said nozzles in said second nozzle array are disposed so as to be offset by ½ pitch with respect to longitudinal central axes of adjacent ones of said nozzles in said first nozzle array.

11. A method for manufacturing a liquid discharge head comprising a discharge energy generating element for generating energy for discharging a liquid droplet, an element substrate having a main surface on which said discharge energy generating element is provided, a discharge port portion having a discharge port for discharging the liquid droplet, a nozzle having a bubbling chamber in which a bubble is generated in liquid by said discharge energy generating element and a supply path for supplying the liquid to said bubbling chamber, a supply chamber for supplying the liquid to said nozzle and an orifice substrate joined to the main surface of said element substrate, said bubbling chamber comprising (a) a first bubbling chamber that communicates with said supply path and uses a portion of the main surface of said element substrate as a bottom surface of said first bubbling chamber and in which the bubble is generated in the liquid by said discharge energy generating element and (b) a second bubbling chamber communicating with said first bubbling chamber and with said discharge port portion, the method comprising the steps of:

coating a thermal bridge type organic resin soluble by solvent and adapted to form a pattern for said first bubbling chamber and a lower portion of said supply path on said element substrate having the main surface on which said discharge energy generating element is provided and heating the resin to form a thermal bridge film;

coating an organic resin soluble by solvent and adapted to form a pattern for said second bubbling chamber and an upper portion of said supply path on said thermal bridge film so as to form a two-layer soluble film;

exposing and developing the organic resin by using near-UV light having a wavelength of 260 to 330 nm in order to form the pattern for said second bubbling chamber and the upper portion of said supply path;

forming an inclination of 10 to 45 degrees on a side surface of the organic resin by heating the exposed, developed and pattern-formed organic resin at a temperature lower than a glass transition point;

exposing and developing said thermal bridge film by using deep-UV light having a wavelength of 210 to 330 nm;

laminating said orifice substrate having the discharge port by coating, exposing, developing and heating a negative type organic resin on a flow path pattern formed by the two-layer soluble film; and forming said discharge port portion for discharging the liquid droplet, said nozzle having said bubbling chamber in which the bubble is generated in the liquid by said discharge energy generating element and said supply path for supplying the liquid to said bubbling chamber, said supply chamber for supplying the liquid to said nozzle and said orifice substrate joined to the main surface of said element substrate, by illuminating deep-UV light onto said negative type organic resin thereby to remove the two-layer soluble film.

12. A method according to claim 11, wherein said second bubbling chamber and the upper portion of said supply path are formed by pattern transferring, by using a photo-mask in which a pattern of said second bubbling chamber is a normal resolving power pattern of the organic resin and a pattern of the upper portion of said supply path is a pattern smaller than a limited resolving power of the organic resin, and by using near-UV light having a wavelength of 260 to 330 nm.

13. A method according to claim 11, wherein, in said exposing and developing step of the organic resin, said second bubbling chamber and the upper portion of said supply path are divided into an area where the resin is removed completely, an area where the resin is removed partially and an area where the resin is not removed at all.

14. A method according to claim 13, wherein, in said exposing and developing step of the organic resin, said area where the resin is not removed at all forms said second bubbling chamber and said area where the resin is removed partially forms the upper portion of said supply path.

15. A method according to claim 11, wherein a height of said first bubbling chamber on said element substrate is 5 to 20 μm and a side wall of said first bubbling chamber is formed with an inclination of 0 to 10° with respect to a plane perpendicular to the main surface of said element substrate.

16. A method according to claim 11, wherein the thermal bridge type organic resin for forming said first bubbling chamber and the lower portion of said supply path comprises methyl methacrylate and is formed by dissolving material obtained by being copolymerized with methacrylic acid and methacrylic acid ester in a coating solvent.

17. A ink jet recording head comprising:

an element substrate having a main surface on which a discharge energy generating element for generating energy for discharging a liquid droplet is provided;

a discharge port portion having a discharge port at one end thereof, the discharge port being opposed to said discharge energy generating element;

a supply path for supplying liquid to said discharge port portion;

a first bubbling chamber using a portion of the main surface of said element substrate as a bottom surface and communicating with said supply path, a bubble being generated in liquid in the first bubbling chamber by said discharge energy generating element; and a second bubbling chamber having one end portion communicating with said first bubbling chamber and another end portion communicating with another end of said discharge port portion, wherein a cross-sectional area of said first bubbling chamber, taken in a plane parallel to the main surface of said element substrate, is larger than a cross-sectional area of said second bubbling chamber, taken in a plane parallel to the main surface of said element substrate, and the cross-sectional area of said second bubbling chamber, taken in the plane parallel to the main surface of said element substrate, is larger than a cross-sectional area of said discharge port portion, taken in a plane parallel to the main surface of said element substrate, wherein each of (a) a connecting portion between a side wall surface of said first bubbling chamber and a side wall surface of said second bubbling chamber and (b) a connecting portion between a side wall surface of said second bubbling chamber and a side wall surface of said discharge port portion has a stepped portion, wherein the side wall surface of said second bubbling chamber has a tapered shape such that an end portion of the side wall surface of said second bubbling chamber at the discharge port portion is smaller than an end portion of the side wall surface of said second bubbling chamber at said first bubbling chamber.

18. An ink jet recording head according to claim 17, wherein the side wall surface of said discharge port portion has a tapered shape so that an end portion of the side wall surface at a side of said discharge port is smaller than an end portion of the side wall surface at a side of said second bubbling chamber side.

19. An ink jet recording head according to claim 18, wherein the side wall surface of said discharge port portion is formed with an inclination of 10 to 45 degrees with respect to a plane perpendicular to the main surface of said element substrate.

20. An ink jet recording head according to claim 17, wherein the side wall surface of said second bubbling chamber is formed with an inclination of 10 to 45 degrees with respect to a plane perpendicular to the main surface of said element substrate.

* * * * *

UNITED STATES PATENT AND TRADEMARK OFFICE

CERTIFICATE OF CORRECTION

PATENT NO. : 7,048,358 B2
APPLICATION NO. : 10/613992
DATED : May 23, 2006
INVENTOR(S) : Masahiko Kubota et al.

It is certified that error appears in the above-identified patent and that said Letters Patent is hereby corrected as shown below:

ON THE COVER PAGE
(Item 74), *Attorney, Agent or Firm*
"Fitzpatrick Cella Harper & Scinto" should read --Fitzpatrick, Cella, Harper & Scinto--.

(Item 57), ABSTRACT
"bulling" should read --bubbling--.

COLUMN 2
Line 16, "and constituting" should read --constitute--.
Line 37, "is flown" should read --is flowed--.

COLUMN 4
Line 19, "the adequate" should read --adequate--.
Line 56, "flown" should read --flowed--.

COLUMN 5
Line 18, "is graphs" should read --are graphs--.

COLUMN 6
Line 53, "act greatly" should read --are most effective--.
Lines 58, "$(\partial v/\theta t)+(v\cdot\Delta)= -\Delta(P/p)+(\mu/p)\Delta^2 v+f$ (*Navie-Stokes*" should read --$(\partial v/\partial t)=(v\cdot\Delta)= -\Delta(P/p)+(\mu/p)\Delta^2 v+f$ (*Navie-Stokes*--.
Line 61, "small adequately" should read --adequately small--.

COLUMN 7
Line 1, "In case" should read --In the case--.
Line 5, "Expressing" should read --Expressed--.
Line 6, "similar" should read --similarly--.
Line 17, "intertance." should read --inertance.--.
Line 51, "stokes" should be deleted.
Line 59, "flown" should read --flowed--.

COLUMN 8
Line 26, "be is" should read --be--.
Line 32, "are arranged" should read --be arranged--.

UNITED STATES PATENT AND TRADEMARK OFFICE

CERTIFICATE OF CORRECTION

PATENT NO. : 7,048,358 B2
APPLICATION NO. : 10/613992
DATED : May 23, 2006
INVENTOR(S) : Masahiko Kubota et al.

It is certified that error appears in the above-identified patent and that said Letters Patent is hereby corrected as shown below:

COLUMN 10
Line 52, “flown” should read --flowed--.

COLUMN 12
Line 53, “(MMA-MAA))” should read --(MMA-MAA)--.

COLUMN 13
Line 63, “as less” should read --or as little--.

COLUMN 14
Line 42, “atmosphere” should read --atmosphere,--.

COLUMN 15
Line 63, “57 has” should read --57 having--.
Line 65, “heater 20” should read --heater 20,--.

COLUMN 17
Line 3, “straightly” should read --straight--.
Line 9, “as less” should read --or as little--.

COLUMN 18
Line 16, “the substantially” should read --substantially--.
Line 48, “is formed” should read --are formed--.

COLUMN 19
Line 3, “30 μm” should read --30 μm--.

COLUMN 20
Line 61, “is hard to be” should read --made hard--.

COLUMN 21
Line 16, “flown” should read --flowed--.

COLUMN 22
Line 28, “flown” should read --flowed--.
Line 40, “flown” should read --flowed--.

UNITED STATES PATENT AND TRADEMARK OFFICE

CERTIFICATE OF CORRECTION

PATENT NO. : 7,048,358 B2
APPLICATION NO. : 10/613992
DATED : May 23, 2006
INVENTOR(S) : Masahiko Kubota et al.

It is certified that error appears in the above-identified patent and that said Letters Patent is hereby corrected as shown below:

COLUMN 23
Line 37, "discharged" should read --be discharged--.

COLUMN 27
Line 9, "A ink" should read --An ink--.

Signed and Sealed this

Thirtieth Day of January, 2007

JON W. DUDAS
*Director of the United States Patent and Trademark Office*